US007370617B2

(12) United States Patent
Maehara et al.

(10) Patent No.: US 7,370,617 B2
(45) Date of Patent: May 13, 2008

(54) VARIABLE VALVE OPERATING MECHANISM OF FOUR-STROKE INTERNAL COMBUSTION ENGINE

(75) Inventors: Hayato Maehara, Saitama (JP); Shinji Saito, Saitama (JP); Akifumi Nomura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 141 days.

(21) Appl. No.: 11/386,832

(22) Filed: Mar. 23, 2006

(65) Prior Publication Data

US 2006/0213470 A1 Sep. 28, 2006

(30) Foreign Application Priority Data

Mar. 24, 2005 (JP) ..... 2005-086913
Aug. 30, 2005 (JP) ..... 2005-248686

(51) Int. Cl.
*F01L 1/02* (2006.01)

(52) U.S. Cl. ..... 123/90.27; 123/90.48; 123/90.15; 123/90.16; 123/90.31

(58) Field of Classification Search ..... 123/90.27
See application file for complete search history.

(56) References Cited

U.S. PATENT DOCUMENTS 5,361,734 A * 11/1994 Shirai ..... 123/90.16
6,302,070 B1 * 10/2001 Tsukui et al. ..... 123/90.16
6,318,316 B1 11/2001 Tsukui et al.
6,571,758 B2 * 6/2003 Tsukui et al. ..... 123/90.16
2001/0018902 A1 9/2001 Tsukui et al.

FOREIGN PATENT DOCUMENTS

| | | |
|---|---|---|
| DE | 29 52 037 A1 | 6/1981 |
| DE | 42 19 435 | 12/1993 |
| EP | 1 462 622 A1 | 9/2004 |
| JP | 2003-27908 A | 1/2003 |

* cited by examiner

*Primary Examiner*—Thomas Denion
*Assistant Examiner*—Kyle M. Riddle
(74) *Attorney, Agent, or Firm*—Birch, Stewart, Kolasch & Birch, LLP

(57) ABSTRACT

A variable valve operating mechanism of a four-stroke internal combustion engine includes a slide pin energized by a pin spring in a direction while oil pressure acting on the slide pin in the opposite direction through oil pressure supply passages. The slide pin moves by controlling the oil pressure causing a stem contact surface and a stem through hole to selectively face a valve stem. The mechanism also includes an oil discharge passage including a discharge port which is opened to allow oil acting the slide pin to be discharged when the valve lifter is pressed by a valve operating cam to move for opening the valve. The mechanism is capable of quickly moving the slide pin upon the release of oil pressure when the valve comes into a quiescent state. Therefore, the response of transitioning the variable valve from an operating state to the quiescent state is improved.

15 Claims, 16 Drawing Sheets

VARIABLE VALVE OPERATING MECHANISM OF FOUR-STROKE INTERNAL COMBUSTION ENGINE

CROSS-REFERENCE TO RELATED APPLICATION

The present application claims priority under 35 U.S.C. §119 to Japanese Patent Application No. 2005-086913, filed Mar. 24, 2005, and Japanese Patent Application No. 2005-248686, filed Aug. 30, 2005, the entire contents of which are hereby incorporated by reference.

BACKGROUND OF THE INVENTION

1. Field of the Invention

The present invention relates to a variable valve operating mechanism of a four-stroke internal combustion engine.

2. Description of Background Art

For a variable valve operating mechanism of a four-stroke internal combustion engine provided including a hydraulically controlled valve pausing mechanism in a valve lifter which is provided between a valve operating cam and a valve stem of a poppet valve, an example is disclosed in Japanese Patent Laid-open Publication No. 2003-27908.

The Japanese Patent Laid-open Publication No. 2003-27908 disclosed the following structure. A slide pin holder is fit and attached in a valve lifter, and a slide pin is fit into the slide pin holder so as to slide in a direction orthogonal to a valve stem. In the slide pin, a stem contact surface abutting on the valve stem of the poppet valve energized by a valve spring and a stem through-hole through which the valve stem penetrates are formed in adjacent to each other. The slide pin is energized by the pin spring in one direction, and oil pressure acts on the slide pin in the opposite direction through an oil pressure supply passage. The slide pin is moved by controlling the oil pressure to cause the stem contact surface and stem through hole to selectively face the valve stem.

Accordingly, when the oil pressure acts to move the slide pin against the pin spring and cause the stem contact surface to face the valve stem, the valve lifter is pressed by the valve operating cam to move, and accordingly, the slide pin presses the valve stem to drive the valve open.

On the other hand, when the oil pressure is released, the slide pin is moved by energizing force of the pin spring to cause the stem through hole to face the valve stem. Even if the valve lifter is pressed by the valve operating cam, therefore, the valve stem penetrates the stem through hole and does not operate, so that the valve is brought into a quiescent state.

In the case where the valve comes into an operating (opening and closing drive) state, when the oil pressure acts on the slide pin, air is released to the opposite side, and the slide pin instantly moves, thus providing a good response. In the case where the valve comes into the quiescent state, however, oil is not actively discharged even if the oil pressure is released. Accordingly, when the oil pressure is not instantly relieved completely, the movement of the slide pin by the spring force of the pin spring is slow, and a desired response cannot be obtained.

Especially in the case of a so-called cylinder quiescent state in which all valves of a cylinder are paused, if the movement of the slide pin is delayed from the release of the oil pressure and the timing of the cylinder to come into the cylinder quiescent state is delayed, fuel feed control becomes difficult to cause fuel to be accumulated or cause pumping loss.

SUMMARY AND OBJECTS OF THE INVENTION

The present invention has been made in the light of such a point, and an object of the present invention is to provide a variable valve operating mechanism of a four-stroke internal combustion engine which is capable of quickly performing the movement of the slide pin upon the release of the oil pressure when the valve comes into the quiescent state and therefore improving the response in the transition of the valve from the operating state to the quiescent state.

According to a first aspect of the present invention, a variable valve operating mechanism of a four-stroke internal combustion engine includes a valve lifter provided between a valve operating cam and a valve stem of a poppet valve is slidably supported by a lifter guide hole and always energized by a lifter spring in a direction to abut on the valve operating cam. A slide pin is fit to a slide pin holder attached in the valve lifter and freely slides in a direction orthogonal to the valve stem. A stem contact surface which abuts on the valve stem of the poppet valve energized by the valve spring and a stem through hole which the valve stem penetrates are formed in adjacent to each other in the slide pin. The slide pin is energized by a pin spring in one direction while oil pressure acts on the slide pin in an opposite direction through an oil pressure supply passage, and the slide pin is moved by controlling the oil pressure to cause the stem contact surface and stem through hole to selectively face the valve stem. The variable valve operating mechanism includes an oil discharge passage including a discharge port which is opened to allow oil acting on the slide pin to be discharged when the valve lifter is pressed by the valve operating cam to move for valve opening.

According to a second aspect of the present invention, the oil pressure supply passage is composed of an annular hydraulic groove communicating through a side hole of the valve lifter with a hydraulic chamber causing oil pressure to act on the slide pin, the annular hydraulic groove being formed in an inner peripheral surface of the lifter guide hole and supplied with oil pressure. The oil discharge passage is composed of an oil discharge groove extended from the annular hydraulic groove in a direction that the valve lifter moves for valve closing. Further, a discharge port of the oil discharge groove is opened when the valve lifter is pressed by the valve operating cam to move for valve opening.

According to a third aspect of the present invention, the oil pressure supply passage is composed of an annular hydraulic groove communicating through a side hole of the valve lifter with a hydraulic chamber causing oil pressure to act on the slide pin in the slide pin holder, the annular hydraulic groove being formed in an inner peripheral surface of the lifter guide hole; the oil discharge passage is composed of an annular oil discharge groove which is formed in the inner peripheral surface of the lifter guide hole apart from the annular hydraulic groove in a direction that the valve lifter moves for valve opening and is communicable with the hydraulic chamber through the side hole of the valve lifter and an oil discharge groove extended from the annular oil discharge groove in a direction that the valve lifter moves for valve opening; and the oil discharge groove is always opened.

According to a fourth aspect of the present invention, a plurality of the oil discharge grooves are formed in the inner peripheral surface of the lifter guide hole across a circumferential direction.

According to a fifth aspect of the present invention, the oil discharge passage is formed in the valve lifter.

According to a sixth aspect of the present invention, the oil pressure supply passage is constituted of an annular hydraulic groove communicating through a side hole of the valve lifter with a hydraulic chamber causing oil pressure to act on the slide pin, the annular hydraulic groove being formed in an inner peripheral surface of the lifter guide hole and supplied with oil pressure. In addition, the oil discharge passage is constituted of an oil discharge groove formed in a peripheral edge portion of a peripheral wall of the valve lifter on a top wall side, and the oil discharge groove communicates with the annular hydraulic groove at a predetermined position when the valve lifter is pressed by the valve operating cam to move for valve opening.

According to a seventh aspect of the present invention, a multiple oil discharge grooves are formed around the entire circumference of the peripheral wall of the valve lifter.

According to an eighth aspect of the present invention, the oil discharge groove is an annular groove formed annularly around the entire circumference of the peripheral wall of the valve lifter.

According to the first aspect of the present invention, when the valve lifter is pressed by the valve operating cam to move for valve opening, the discharge port of the oil discharge passage is opened to allow oil acting on the slide pin to be discharged. Accordingly, the slide pin is smoothly moved by the spring force of the pin spring. When the oil pressure is released while the valve is operating, therefore, the slide pin quickly moves, thus improving the response in the transition of the valve from the operating state to the quiescent state.

According to the second aspect of the present invention, the oil discharge groove is extended in the direction that the valve lifter moves for valve closing from the annular hydraulic groove which communicates with the hydraulic chamber. When the valve lifter moves for valve opening, the discharge port of the oil discharge groove is opened. Accordingly, the timing to release oil pressure of the hydraulic chamber can be set by a length of the oil discharge groove, and desired response can be obtained by the release of oil pressure in the transition of the valve from the operating state to the quiescent state.

According to the third aspect of the present invention, the oil discharge groove is extended so as to be always opened from the annular oil discharge groove which can communicate with the hydraulic chamber. When the valve lifter moves for valve opening, therefore, the hydraulic chamber can communicate with the annular oil discharge groove to release the oil pressure. The timing to release the oil pressure of the hydraulic chamber can be set by a position where the annular oil discharge groove is formed. It is therefore possible to obtain desired response by release of oil pressure in the transition of the valve from the operating state to the quiescent state.

According to the fourth aspect of the present invention, the plurality of oil discharge grooves are formed in the inner peripheral surface of the lifter guide hole across the circumferential direction. Accordingly, even if the valve lifter is rotated, a path to discharge oil in the hydraulic chamber can be maintained substantially constant as the minimum distance from the hydraulic chamber to the discharge ports of the oil discharge grooves, and the response in the transition of the valve from the operating state to the quiescent state can be set substantially constant. Moreover, the response can be controlled by the number of oil discharge grooves.

According to the fifth aspect of the present invention, the oil discharge passage is formed in the valve lifter. Accordingly, the oil discharge passage is easy to machine.

According to the sixth aspect of the present invention, the oil discharge groove is formed in the peripheral edge portion of the peripheral wall of the valve lifter on the top wall side, and the oil discharge groove communicates with the annular hydraulic groove at a predetermined position when the valve lifter moves for valve opening. Accordingly, the oil pressure in the hydraulic chamber can be released from the annular hydraulic groove through the oil discharge groove communicating therewith, and desired response can be obtained by the release of oil pressure in the transition of the valve from the operating state to the quiescent state.

The timing when the oil discharge groove communicates with the annular hydraulic groove to release oil pressure in the hydraulic chamber can be set by the position where the annular hydraulic groove is formed.

According to the seventh aspect of the present invention, the plurality of oil discharge grooves are formed around the entire circumference of the peripheral wall of the valve lifter. Accordingly, even if the valve lifter is rotated, the minimum distance between the hydraulic chamber and the positions where the annular hydraulic groove communicates with the oil discharge grooves can be maintained substantially constant. The response time which is shortened by oil discharge in the transition of the valve from the operating state to the quiescent state can be therefore set substantially constant.

Moreover, the response can be controlled by the number of the oil discharge grooves.

According to the eighth aspect of the present invention, the oil discharge groove is an annular groove which is formed annularly around the entire circumference of the peripheral wall of the valve lifter. Accordingly, rotation of the valve lifter does not affect the response in the transition of the valve from the operating state to the quiescent state, and the response can be set always constant.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a description will be given of an embodiment according to the present invention with reference to FIGS. 1 to 9.

An internal combustion engine 1 according to the embodiment is a water-cooled DOHC four-stroke cycle parallel four-cylinder internal combustion engine mounted on a two-wheeled motor vehicle, in which four cylinders are aligned in a vehicle width direction (lateral direction).

Among the four cylinders formed of cylinder blocks 2 of the internal combustion engine 1, right two cylinders are always operating cylinders, and left two cylinders are cylinders which can be paused.

Figure 1:
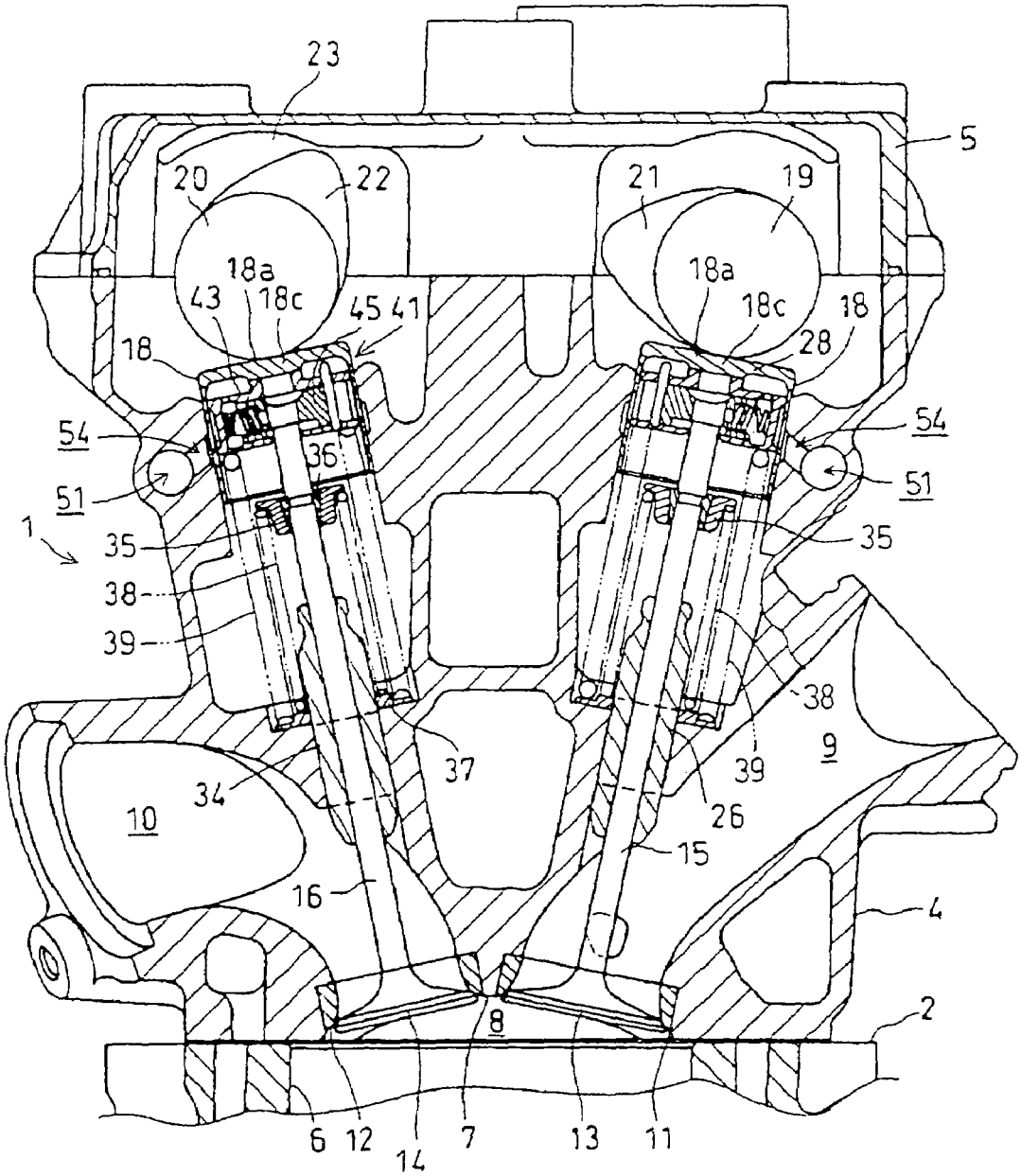
FIG. 1 is a schematic side view of a four-stroke internal combustion engine with a valve pausing mechanism according to the present invention.

FIG. 1 shows a cross-sectional view of a part of the cylinder block 2 for one of the cylinders which can be paused, a cylinder head 4 which is superposed and connected to the foregoing cylinder block 2, and a cylinder head cover 5 which covers the same.

In a bottom surface of each cylinder head 4, as shown in FIG. 1, a pentroof-shaped concave portion 7 is formed at a place corresponding to a cylinder bore 6. A piston (not shown) fit into the cylinder bore 6, the cylinder bore 6, and the concave portion 7 define a combustion chamber 8.

Furthermore, as shown in FIG. 1, in a rear portion of the cylinder head 4, an intake port 9 is formed. In the intake port 9, an upstream intake passage connected to an intake apparatus is separated into two intake passages at an intake downstream side, leading to two openings on the combustion chamber 8. In a front part of the cylinder head 4, an exhaust port 10 is formed. In the exhaust port 10, two upstream exhaust passages led from other two openings on the combustion chamber 8 gather into one exhaust passage at an exhaust downstream side to be connected to a not-shown exhaust tube. The cylinder head 4 is provided with intake poppet valves 13 and 13 and exhaust poppet valves 14 and 14, which, respectively, hermetically close two intake openings 11 and 11 and two exhaust openings 12 and 12 so as to freely open and close the same.

On an upper extension of a valve stem 15 of each intake poppet valve 13, an intake camshaft 19 is disposed, and on an upper extension of a valve stem 16 of each exhaust poppet valve 14, an exhaust camshaft 20 is disposed. The intake and exhaust camshafts 19 and 20 are rotatably attached to the cylinder head 4 by a cam shaft holder 23.

The internal combustion engine 1 is therefore a so-called DOHC internal combustion engine.

An intake cam 21 of the intake camshaft 19 and an exhaust cam 22 of the exhaust camshaft 20 for each cylinder bore 6 abut on top surfaces of a valve lifter 17 with a valve pausing mechanism of the intake poppet valve 13 and a valve lifter 18 with a valve pausing mechanism of the exhaust poppet valve 14, respectively. A right end (on a right side in a vehicle body) of each of the intake and exhaust camshafts 19 and 20 is integrally attached to a not-shown driven sprocket, and a not-shown endless chain is laid on the driven sprocket and a drive sprocket (not shown) integrated with a not-shown crankshaft. When the DOHC four-stroke internal combustion engine 1 comes into an operating state, therefore, the intake and exhaust cams 21 and 22 are driven to rotate at a speed half of the rotation speed of the crankshaft in the same direction.

The valve pausing mechanisms annexed to the intake and exhaust poppet valves 13 and 14 are structured to be longitudinally symmetric to each other. A description will be therefore mainly given of the exhaust poppet valve 14.

Figure 2:
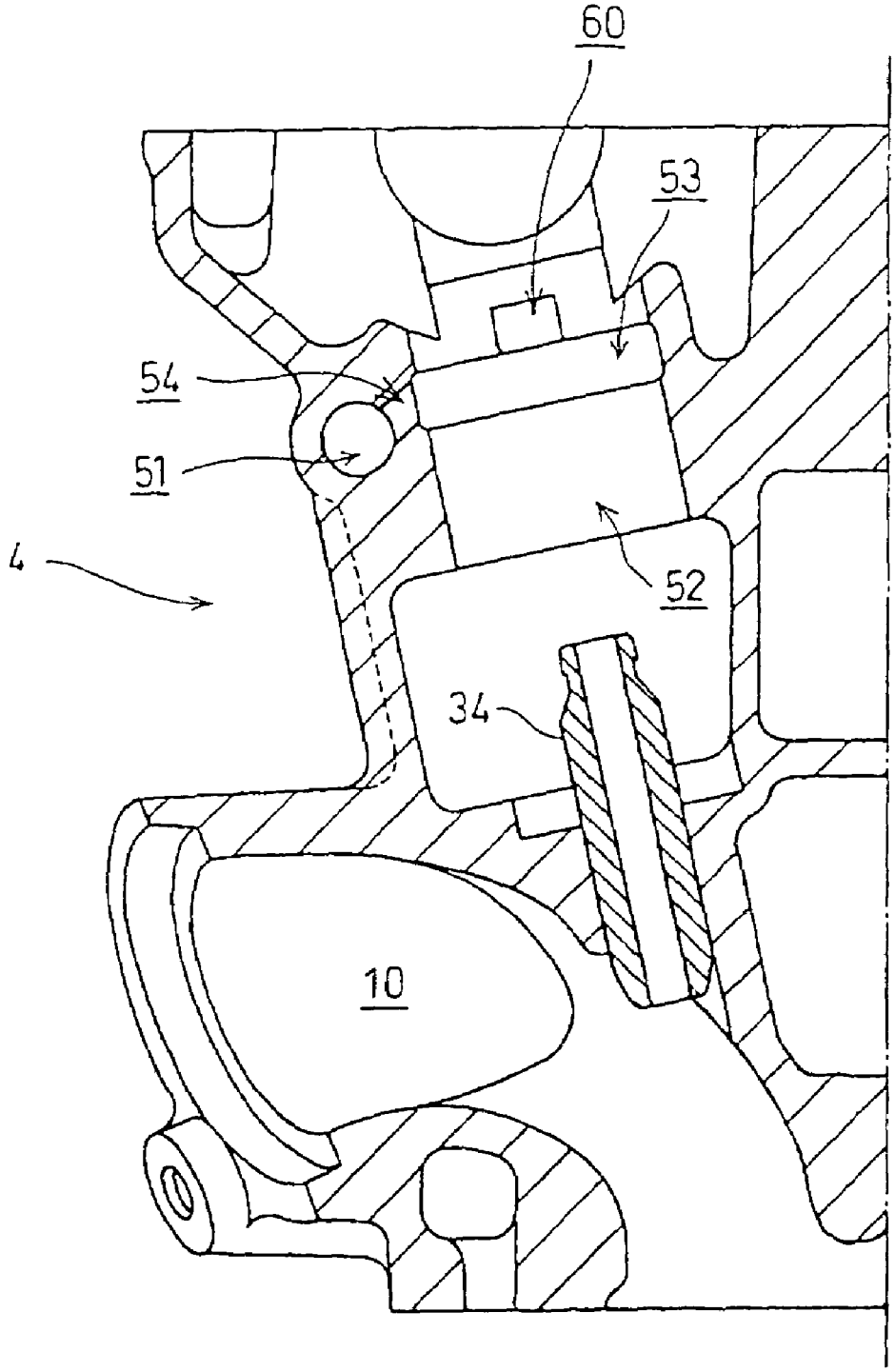
FIG. 2 is a partial cross-sectional view of a cylinder head of the internal combustion engine.

In the cylinder head 4, as shown in FIG. 2, a valve guide tube 34 is attached in the exhaust port 10. The valve guide tube 34 supports the valve stem 16 so that the valve stem 16 freely slides toward the opening of the combustion chamber 8. Moreover, a large-diameter lifter guide hole 52, which supports the valve lifter 18 with a valve pausing mechanism, is formed in a part coaxial with the valve guide tube 34 on an extension of the valve guide tube 34.

At a predetermined upper position of an inner peripheral surface of the lifter guide hole 52, in which the valve lifter 18 reciprocatingly slides, an annular hydraulic groove 53 is formed. The annular hydraulic groove 53 communicates with a hydraulic passage 51 of the cylinder head 4.

Moreover, from the annular hydraulic groove 53, an oil discharge groove 60 is extended by a predetermined length in a direction that the valve lifter 18 moves for valve closing.

In the exhaust poppet valve 14, the valve stem 16 penetrates the valve guide tube 34, and the valve lifter 18 with a valve pausing mechanism, which is annexed to the upper end of the valve stem 16, is slidably fit into the lifter guide hole 52.

The annular hydraulic groove 53, which is formed in the inner peripheral surface of the lifter guide hole 52, has an annular opening closed by the valve lifter 18.

For the exhaust poppet valve 14 provided with the valve lifter 18 with a valve pausing mechanism, the valve guide tube 34, which slidably guides and supports the valve stem 16 of the exhaust poppet valve 14, is formed shorter by a height of the valve pausing mechanism. A retainer 35 is fit to an upper intermediate part of the valve stem 16 of the exhaust poppet valve 14 instead of the top end thereof. The retainer 35 is integrally fixed to the upper part of the valve stem 16 with a cotter 36, and a valve spring 38 is set between the retainer 35 and a spring receiver piece 37 near the upper part of the valve guide tube 34.

A lifter spring 39 with a larger winding diameter than that of the valve spring 38 is set between the spring receiver piece 37 and the valve lifter 18 with a valve pausing mechanism.

The exhaust poppet valve 14 is always energized by spring force of the valve spring 38 in such a direction that the exhaust opening 12 of the exhaust port 10 is hermetically closed, and a top wall 18*a* of the valve lifter 18 with a valve pausing mechanism is energized by spring force of the lifter spring 39 in a direction to abut on the exhaust cam 22.

In a center portion of the top wall 18*a* of the valve lifter 18 with a valve pausing mechanism, a thick wall portion 18*c* serving as a shim is formed to be slightly thicker than an outer periphery thereof. The thick wall shim portion 18*c* is formed to have various thicknesses to prepare several types of the valve lifter 18 with a valve pausing mechanism.

Next, a description will be given of a valve pausing mechanism 41 of the valve lifter 18 with a valve pausing mechanism.

As shown in FIGS. 3 to 6, the valve lifter 18 with a valve pausing mechanism freely slides vertically with a cylindrical peripheral wall 18*b* guided by the lifter guide hole 52, which is provided for the cylinder head 4. In the valve lifter 18 with a valve pausing mechanism, a slide pin holder 43 is fit.

Figure 5:
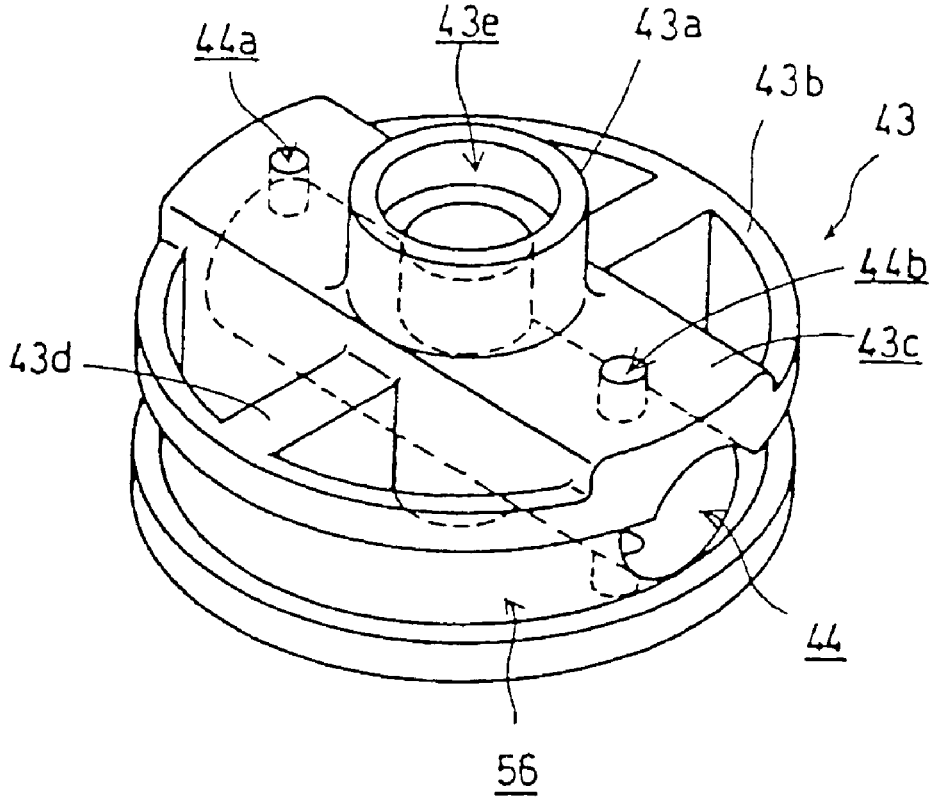
FIG. 5 is a perspective view of a slide pin holder.

As shown in FIG. 5, the slide pin holder 43 includes a center cylindrical portion 43*a* and a ring portion 43*b* therearound, which are connected to each other by cross members 43*c* and 43*d*. A hole of the cylindrical portion 43*a* serves as a stem guide hole 43*e*, and an outer peripheral recessed groove 56 is formed in an outer peripheral surface of the ring portion 43*b*. A slide pin hole 44 is formed in the cross member 43*c*, which is directed in one diameter direction and closes one end of the slide pin hole 44. A through hole 44*a* is provided near the closed end of the slide pin hole 44, and a guide pin hole 44*b* is penetrated at the other end which is opened.

The slide pin holder 43 is inserted with the ring portion 43*b* brought along the cylindrical peripheral wall 18*b* of the valve lifter 18 with a valve pausing mechanism, and the upper end of the cylindrical portion 43*a* is caused to abut on the shim portion 18*c*.

In the slide pin hole 44 of the slide pin holder 43, a slide pin 45 is slidably fit.

Figure 6:
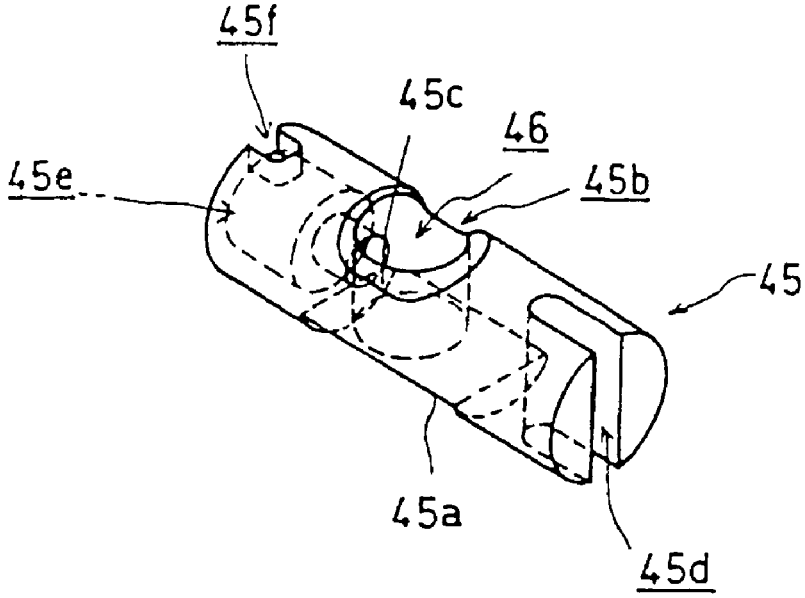
FIG. 6 is a perspective view of a slide pin.

As shown in FIG. 6, the slide pin 45 is cylindrical, in which a part of the side face is cut off into a plane to form a stem contact surface 45*a*. In adjacent to the stem contact surface 45*a*, a stem through hole 46 is drilled to be vertical to the stem contact surface 45*a* and orthogonal to a pin cylinder center axis.

An edge of the stem through hole 46 the side face is chamfered behind the stem contact surface 45*a* in the side face of the slide pin 45. In the chamfered portion 45*b*, a plane 45*c*, which vertically crosses the center axis of the stem through hole 46, is formed, and each end of the plane 45*c* in the direction of the center axis of the slide pin 45 forms a smooth curved face to be continued to the outer peripheral surface of the slide pin 45.

On one end of the slide pin 45, a guide groove 45*d* is formed in a radial direction, and on the other end, a spring guide hole 45*e* is provided. A part of an opening edge of the spring guide hole 45*e* is cut off to form an air groove 45*f*.

A pin spring 49 is fit into the spring guide hole 45*e* of the slide pin 45, and the slide pin 45 is inserted into the slide pin hole 44 of the slide pin holder 43 with the pin spring 49 ahead. The guide pin 47 is fit into the guide pin hole 44*b* and penetrated through the guide groove 45*d* of the slide pin 45 to restrict the position of the slide pin 45. Moreover, the guide pin 47 restricts the movement of the slide pin 45 energized by the pin spring 49.

When the slide pin 45 is inserted into the slide pin hole 44 of the slide pin holder 43, a hydraulic chamber 57 is formed on the guide groove 45*d* side of the slide pin 45, and an air chamber 58 is formed on the slide pin hole 44 side.

The slide pin holder 43 with the slide pin 45 inserted as described above is inserted into the valve lifter 18 with a valve pausing mechanism.

Figure 3:
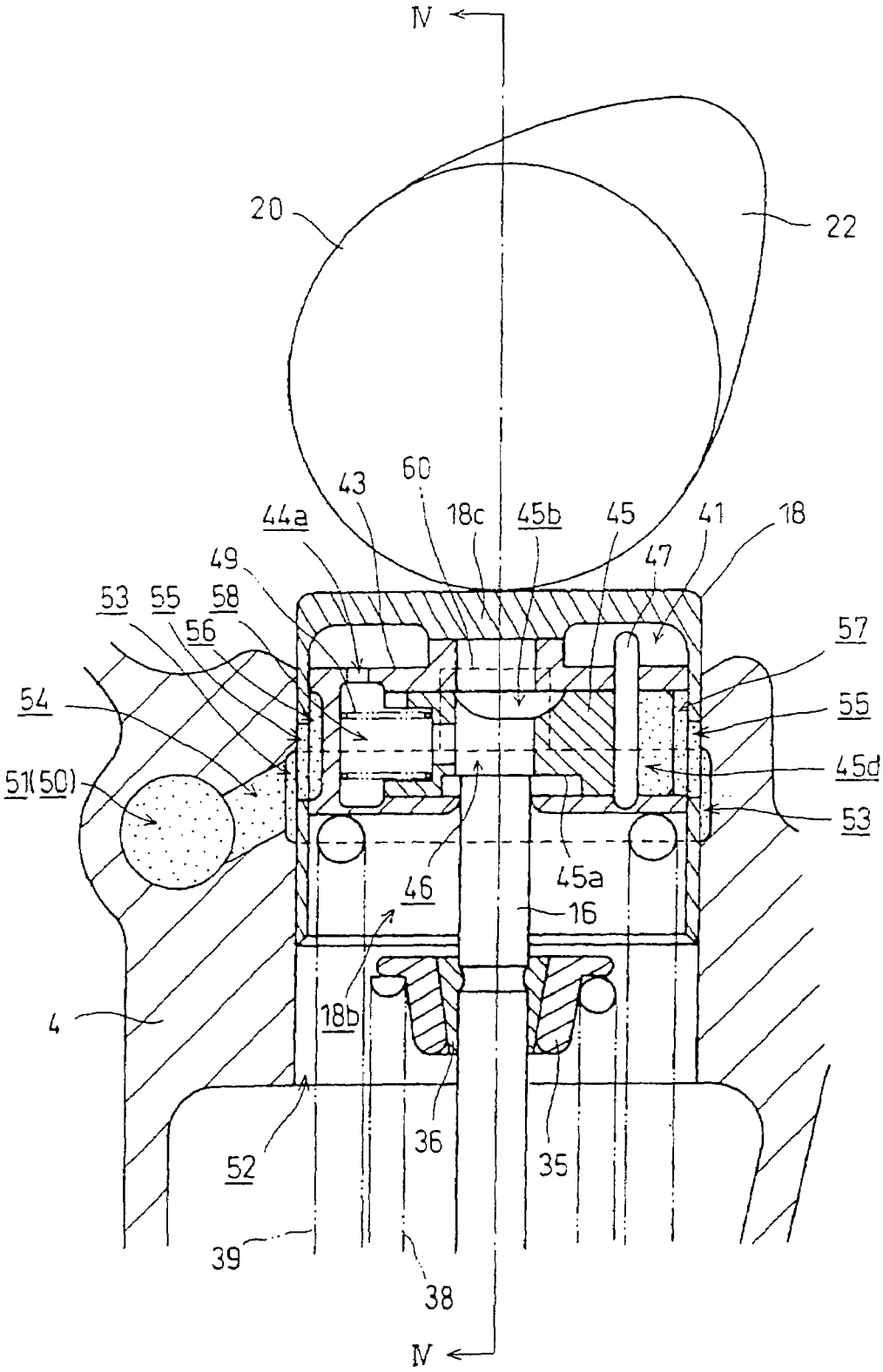
FIG. 3 is an enlarged cross-sectional view of a main portion of FIG. 1 when the valve lifter is located at an up position in a valve quiescent state.

When this valve lifter 18 with a valve pausing mechanism is fit into the lifter guide hole 52, as shown in FIG. 3, the top end of the valve stem 16 of the exhaust poppet valve 14 is guided to the lower portion of the stem guide hole 43*e* of the slide pin holder 43 and faces the stem through hole 46 or stem contact surface 45*a*.

The lifter spring 39 energizes the valve lifter 18 with a valve pausing mechanism upward through the slide pin holder 43 with the upper end thereof abutting on the slide pin holder 43 and causes the valve lifter 18 to abut on the exhaust cam 22.

In the cylindrical peripheral wall 18*b* of the valve lifter 18 with a valve pausing mechanism, a plurality of side holes 55, which communicate with the outer peripheral recessed groove 56 of the slide pin holder 43 wherever the valve lifter 18 with a valve pausing mechanism is located, are drilled. The annular hydraulic groove 53 is formed in the lifter guide hole 52 of the cylinder head 4 so as to communicate with the side holes 55 wherever the valve lifter 18 with a valve pausing mechanism is located.

The hydraulic passage 51 is connected through a control valve (not shown) to an outlet port of a not-shown hydraulic pump provided within the four-stroke internal combustion engine 1.

Such a hydraulic drive system 50 allows pressurized oil to be introduced from the hydraulic passage 51 through a communication hole 54, the annular hydraulic groove 53, the side holes 55, the outer peripheral recessed groove 56, the opening portion of the slide pin hole 44 of the slide pin holder 43 into the hydraulic chamber 57, thus sliding the slide pin 45 against the pin spring 49.

Hereinabove, the valve pausing mechanism of the exhaust poppet valve 14 is explained. The valve pausing mechanism of the intake poppet valve 13 has the same structure, and same members are given same reference numerals (see FIG. 1).

Figure 4:
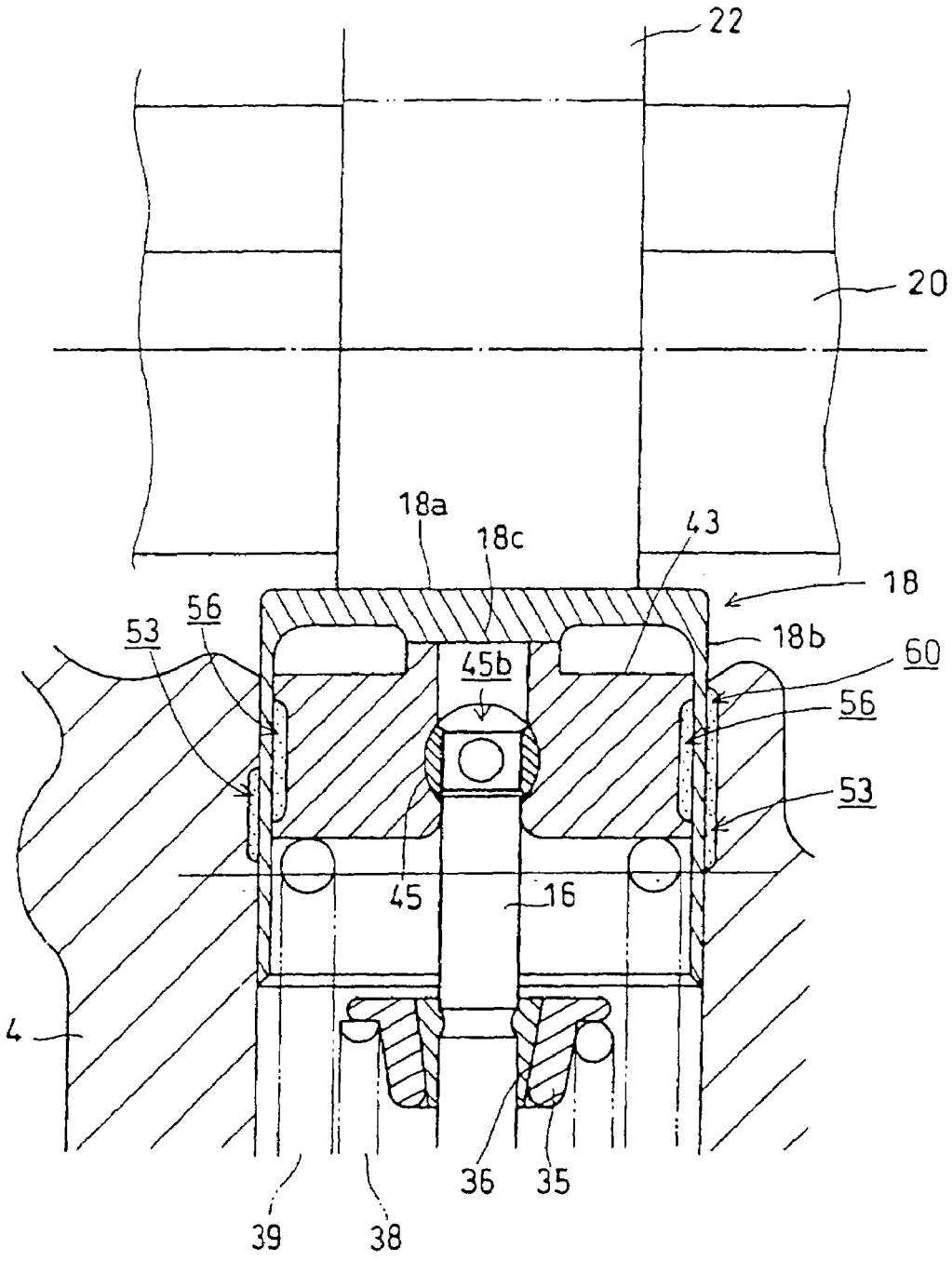
FIG. 4 is a cross-sectional view taken along the line IV-IV of FIG. 3.

While the four-stroke internal combustion engine 1 operates at a low speed or low load and the pressurized oil is not being supplied to the hydraulic passage 51, the pressurized oil is not introduced into the hydraulic chamber 57 of the slide pin hole 44. The slide pin 45 is therefore energized by spring force of the pin spring 49 to move, and the bottom portion of the guide groove 45*d* is stopped by the guide pin 47 with the stem through hole 46 positioned just above the valve stem 16 as shown in FIGS. 3 and 4.

Figure 7:
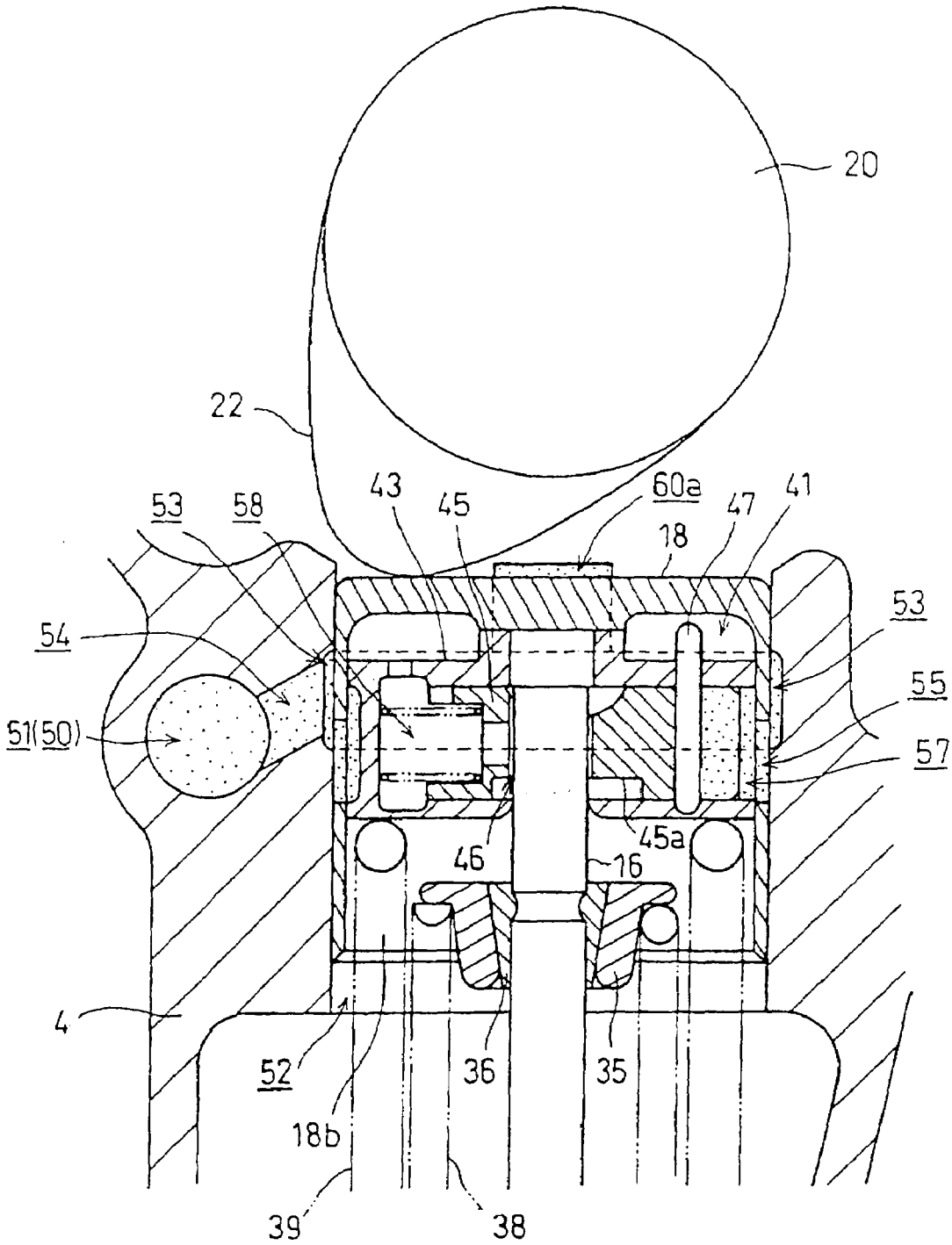
FIG. 7 is an enlarged cross-sectional view of the main portion when the valve lifter is located at a down position in the valve quiescent state.

In this low speed/low load operating state, as shown in FIG. 7, the top of the valve stem 16 (15) of the exhaust poppet valve 14 (and intake poppet valve 13) can freely relatively slide through the stem through hole 46 of the slide pin 45. Accordingly, even when the valve lifter 18 with a valve pausing mechanism is driven by the exhaust cam 22 (intake cam 21) to go up and down, the exhaust poppet valve 14 (intake poppet valve 13) is kept closed, thus achieving the cylinder quiescent state.

Figure 8:
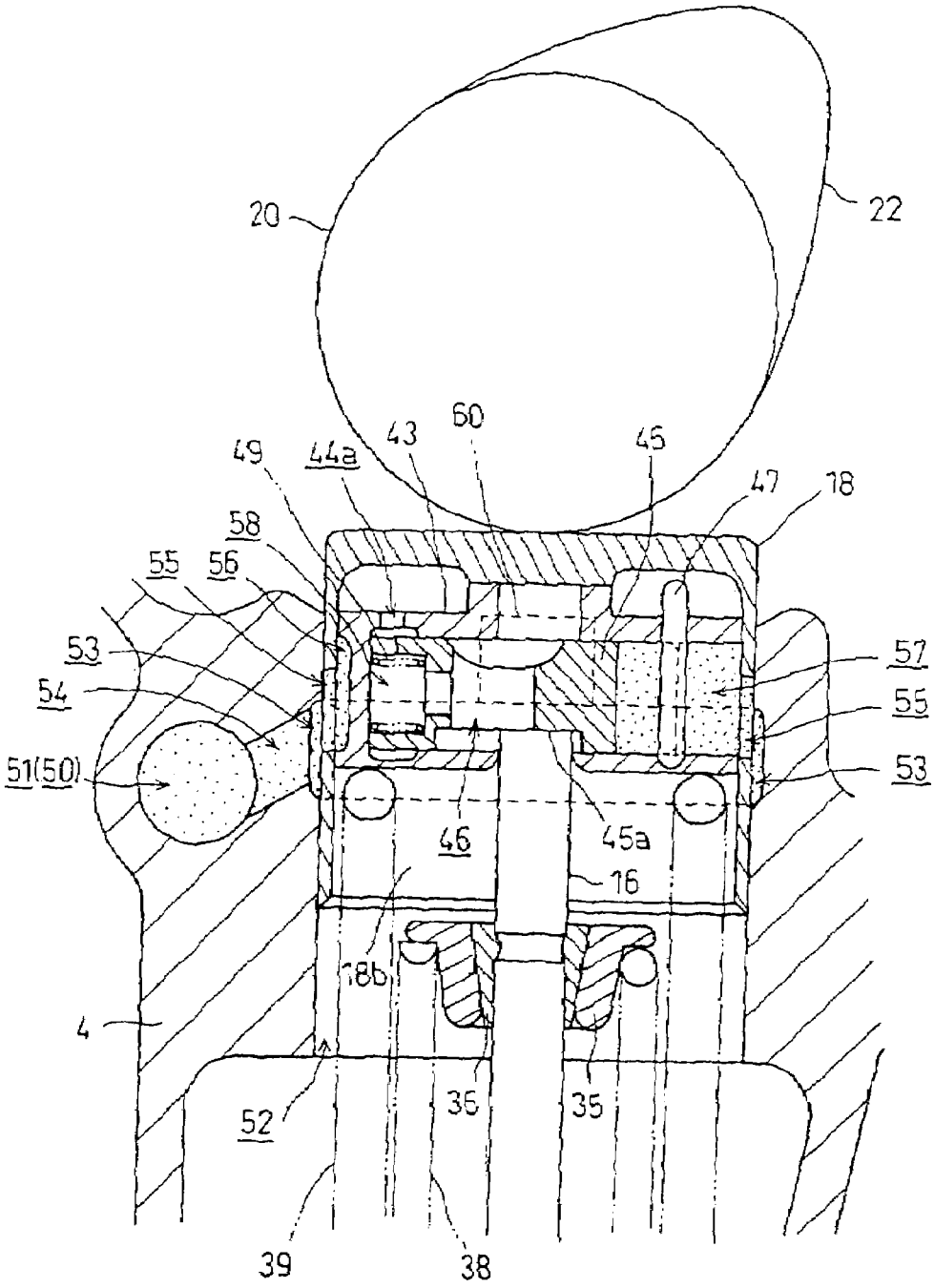
FIG. 8 is an enlarged cross-sectional view of the main portion when the valve lifter is located at the up position in a valve operating state.
Figure 9:
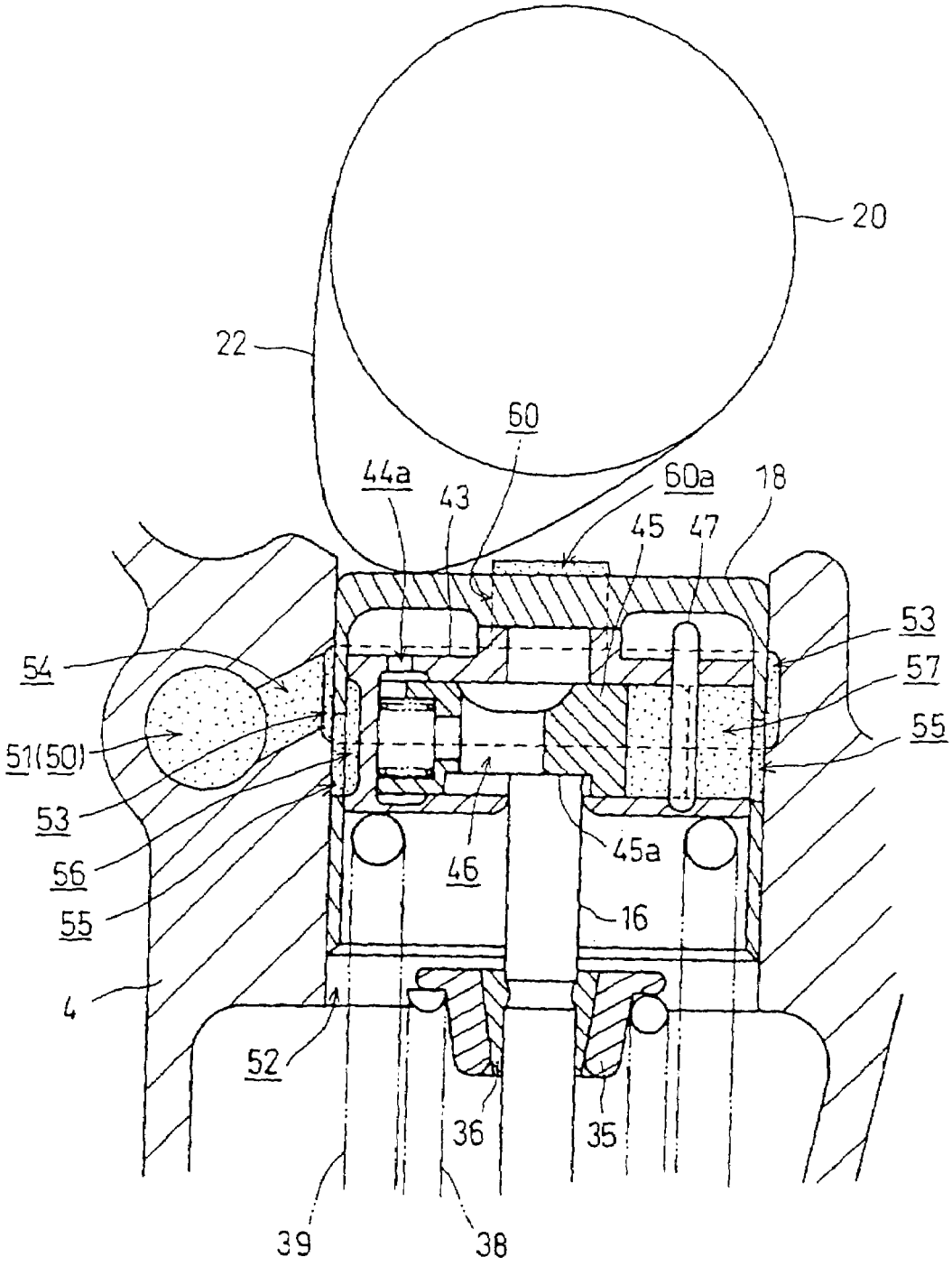
FIG. 9 is an enlarged cross-sectional view of the main portion when the valve lifter is located at the down position in the valve operating state.

On the other hand, when the four-stroke internal combustion engine 1 is operated at a high speed or high load and the pressurized oil is supplied to the hydraulic passage 51, the pressurized oil is introduced from the hydraulic passage 51 through the communication hole 54, annular hydraulic groove 53, side holes 55, and outer peripheral recessed groove 56 into the hydraulic chamber 57 within the slide pin hole 44. The slide pin 45 is moved by oil pressure of the hydraulic chamber 57 against the spring force of the pin spring 49, and, as shown in FIG. 8, the stem contact surface 45*a* of the slide pin 45 faces the top end of the valve stem 16 (15) of the exhaust poppet vale 14 (intake poppet valve 13). When the valve lifter 18 with a valve pausing mechanism is driven up and down by the exhaust cam 22 (intake cam 21), as shown in FIG. 9, the exhaust poppet valve 14 (intake poppet valve 13) is opened and closed through the slide pin 45.

Herein, when the valve is transitioned from the quiescent state into the operating (opening and closing drive) state, pressurized oil is introduced into the hydraulic chamber 57 and the oil pressure acts on the slide pin 45. Accordingly, air in the air chamber 58 opposite to the slide pin 45 is released through an air groove 45*f*, and the slide pin 45 instantly moves, thus providing a good response.

On the contrary, in the case where the valve comes into the quiescent state from the operating state, even when the oil pressure is released, the slide pin 45 is not moved by the spring force of the pin spring 49 as long as the valve stem 16 is pressed against the stem contact surface 45*a* of the slide pin 45. Accordingly, if oil pressure of the hydraulic chamber 57 is not instantly relieved completely similar to the conventional valve pausing mechanism, the slide pin 45 is difficult to move, thus increasing a response time from the release of oil pressure to the time when the slide pin 45 is actually moved to bring the valve into the quiescent state.

In this embodiment, an oil discharge groove 60 is extended in a predetermined length from the annular hydraulic groove 53 in a direction that the valve lifter 18 moves for valve closing. As shown in FIG. 9, when the valve lifter 18 with a valve pausing mechanism is pressed by the exhaust cam 22 to move (go down) for valve opening, the upper end of the oil discharge groove 60 closed by the valve lifter 18 is opened as a discharge port 60*a* at a predetermined height near the lowest position to allow oil to be discharged.

The oil pressure of the hydraulic chamber 57 is instantly released. When the valve lifter 18 goes up to reduce the pressing force of the valve stem 16 on the stem contact surface 45*a* of the slide pin 45, therefore, the slide pin 45 is moved by the spring force of the pin spring 49 to bring the valve into the quiescent state.

Accordingly, the slide pin 45 is moved to bring the valve into the quiescent state in a short response time after the release of oil pressure, so that the response is considerably improved.

As described above, the response in the transition of the valve from the operating state into the quiescent state is improved to become substantially comparable with that of the reverse case. The transition of the cylinder between the operating state and the quiescent state is thus quickly carried out in both directions. It is therefore possible to perform precise fuel feed control and reduce the fuel consumption.

The upper end of the oil discharge groove 60, which serves as the discharge port 60*a*, is formed in the inner peripheral surface of the lifter guide hole 52. The higher the discharge port 60*a* of the oil discharge groove 60 is, the earlier the oil begins to be discharged and the better the response is when the valve is brought into the quiescent state. However, the upper end of the oil discharge groove 60 (i.e., the discharge port 60*a*) being located at the higher position accordingly requires more oil to be discharged. The position of the upper end of the oil discharge groove 60 is therefore properly set based on the desired response and the oil supply performance of the internal combustion engine.

The oil discharge groove 60 is extended from the annular hydraulic groove 53, but a plurality of oil discharge grooves may be extended across the circumferential direction. The path to discharge oil within the hydraulic chamber 57 can be maintained substantially constant as the minimum distance from the hydraulic chamber 57 to any one of the discharge ports 60*a* of the oil discharge grooves 60 wherever the hydraulic chamber 57 pressing the slide pin 45 is positioned by rotation of the valve lifter 18. Accordingly, the response in the transition of the valve from the operating state to the quiescent state can be maintained substantially constant.

Moreover, the response can be controlled by the number of the oil discharge grooves 60.

Next, a description will be given of another embodiment with reference to FIGS. 10 to 12.

A valve pausing mechanism 80 in a variable valve operating mechanism according to this embodiment is almost the same as the valve pausing mechanism 41 of the aforementioned embodiment except an oil discharge passage formed in a cylinder head 81.

The members other than the cylinder head 81 are therefore indicated by the same reference numerals as those of the aforementioned embodiment.

Figure 10:
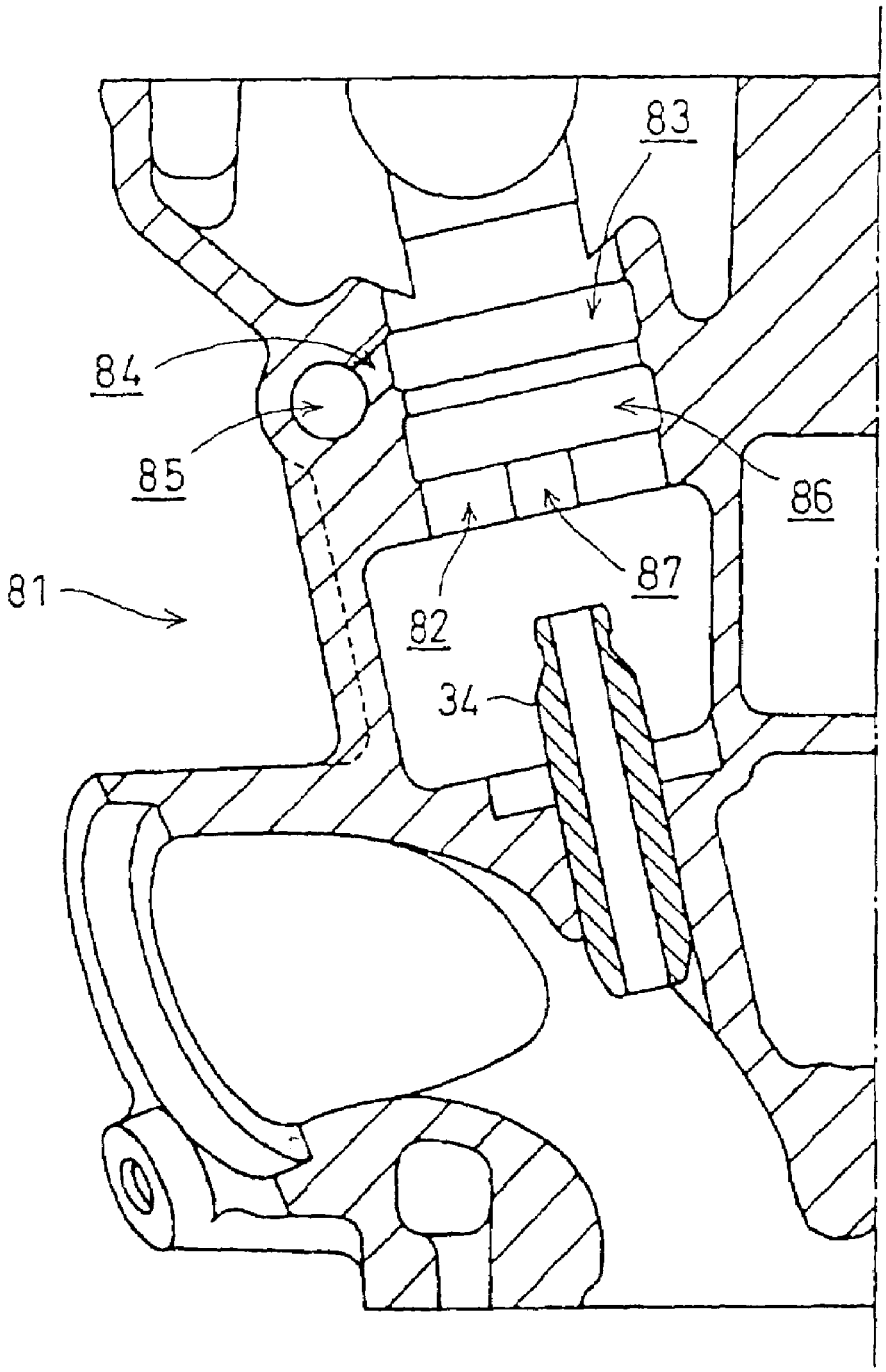
FIG. 10 is a cross-sectional view of a cylinder head of an internal combustion engine according to another embodiment.

As shown in FIG. 10, the cylinder head 81 includes an annular hydraulic groove 83, which is the same as that of the aforementioned embodiment, at a predetermined upper position of the inner peripheral surface of a lifter guide hole 82, which slidably supports the valve lifter 18 with a valve pausing mechanism. The annular hydraulic groove 83 communicates with a hydraulic passage 85 of the cylinder head 81 through a communication hole 84.

In the inner peripheral surface of the lifter guide hole 82, an oil discharge groove 86 is formed a predetermined distance apart from the annular hydraulic groove 83 in a direction that the valve lifter 18 moves for valve opening (downward). From the annular oil discharge groove 86, an oil discharge groove 87 is extended in the direction that the valve lifter 18 moves for valve opening (downward), thus constituting the oil discharge passage.

The oil discharge groove 87 is opened at the lower end thereof when the valve lifter 18 goes down to reach the lowest position as well as when the valve lifter 18 is raised.

Figure 11:
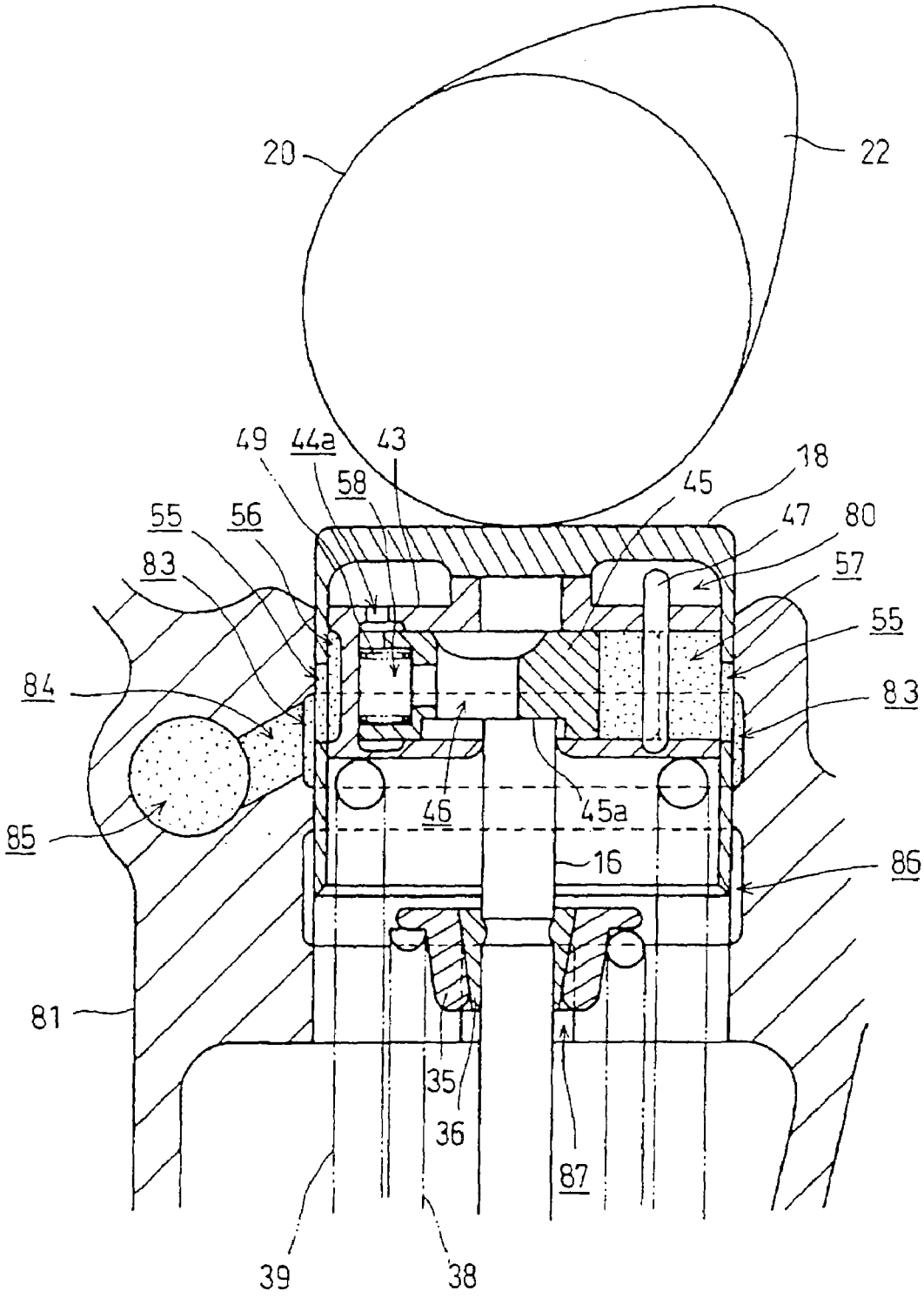
FIG. 11 is an enlarged cross-sectional view of a main portion when the valve lifter is located at an up position in a valve operating state.

As shown in FIG. 11, when the valve lifter 18 is located in an upper position, the hydraulic chamber 57 within the slide pin hole 44 communicates with the annular hydraulic groove 83 through the outer peripheral recessed groove 56 of the slide pin holder 43 and the side holes 55 of the valve lifter 18. Accordingly, pressurized oil is introduced from the hydraulic passage 51 through the communication hole 54, annular hydraulic groove 83, side holes 55, and outer peripheral recessed groove 56 into the hydraulic chamber 57 within the slide pin hole 44.

Upon oil pressure being supplied to the hydraulic chamber 57, the slide pin 45 is moved against the spring force of the pin spring 49, and the stem contact surface 45*a* of the slide pin 45 faces the top end of the valve stem 16 (15) of the exhaust poppet valve 14 (intake poppet valve 13). The valve lifter 18 with a valve pausing mechanism is then driven up and down by the exhaust cam 22 (intake cam 21), so that the valve comes into the operating state.

Figure 12:
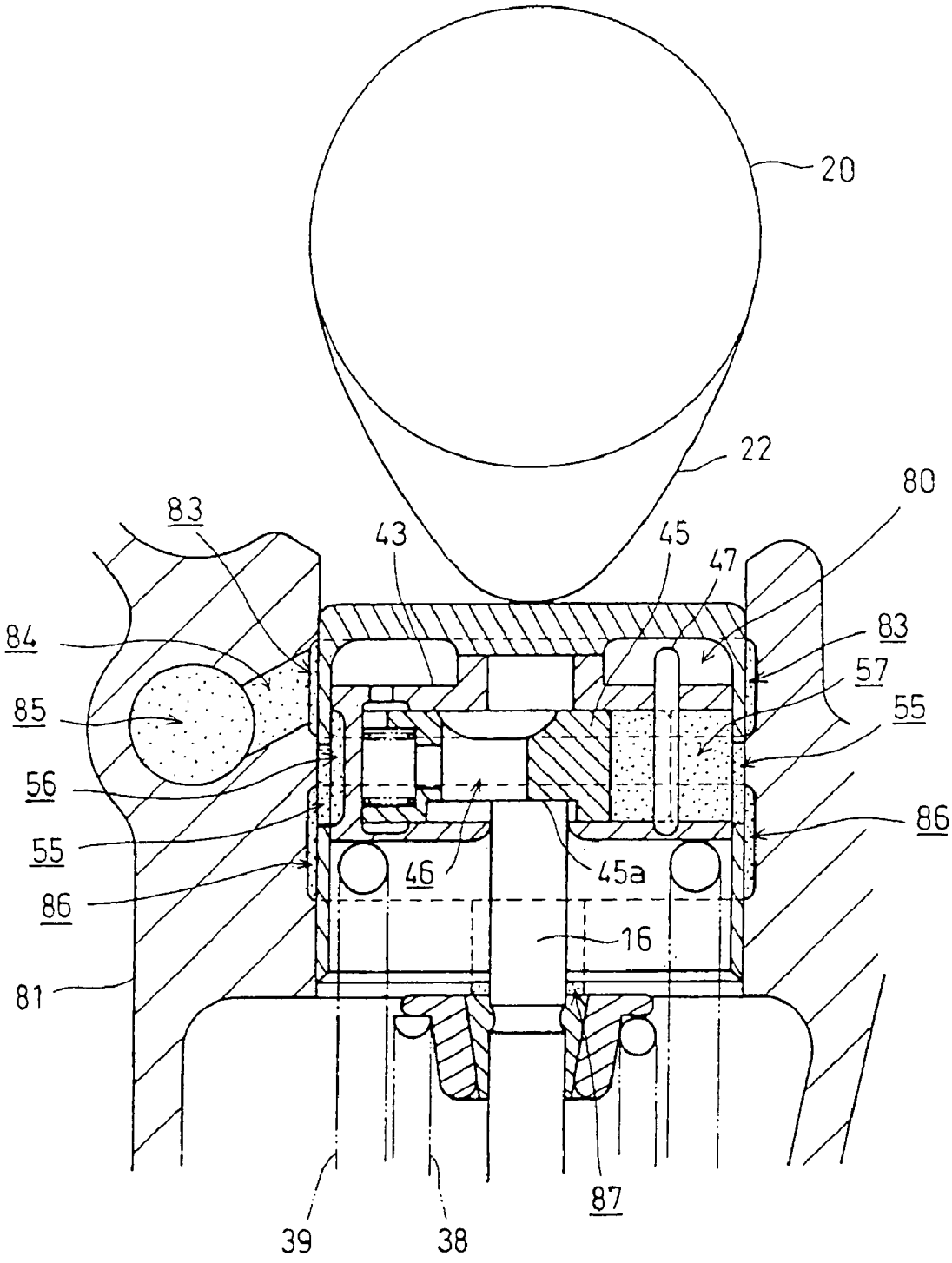
FIG. 12 is an enlarged cross-sectional view of the main portion when the valve lifter is located at a down position in the valve operating state.

When the valve lifter 18 goes down by the exhaust cam 22 (intake cam 21), as shown in FIG. 12, and the side holes 55 of the valve lifter 18, which communicate with the hydraulic chamber 57 within the slide pin hole 44, overlap the annular oil exhaust groove 86, oil within the hydraulic chamber 57 is discharged from the oil discharge groove 87 through the outer peripheral recessed groove 56 of the slide pin holder 43, side hole 55, and annular oil discharge groove 86.

The oil pressure of the hydraulic chamber 57 is therefore instantly relieved. Then, when the valve lifter 18 goes up to reduce the pressing force of the slide pin 45 of the valve stem 16 on the stem contact surface 45*a*, the slide pin 45 is moved by the spring force of the pin spring 49 to surely bring the valve into the quiescent state.

Accordingly, the slide pin 45 is moved to bring the valve into the quiescent state in a short response time after the release of oil pressure, and the response is considerably improved.

As described above, the response when the valve is brought into the quiescent state from the operating state is improved and becomes substantially comparable to that of the reverse case. The transition of the cylinder between the operating state and the quiescent state is quickly performed in both directions. It is therefore possible to perform precise fuel feed control and reduce the fuel consumption.

The higher the position of the upper edge of the annular oil discharge groove 86, which is formed in the inner peripheral surface of the lifter guide hole 82, is, the earlier the upper edge overlaps the side holes 55 of the valve lifter 18 going down, in other words, the earlier the annular oil discharge grooves 86 communicates with the hydraulic chamber 57, thus providing good response when the valve is brought into the quiescent state.

However, this accordingly requires more oil to be discharged, and the position of the upper end of the annular oil discharge groove 86 is therefore properly set based on the desired response and the oil supply performance of the internal combustion engine.

Note that the oil discharge groove 87 is singly extended from the annular oil discharge groove 86, but a plurality of the oil discharge grooves 87 may be extended across the circumferential direction. The path to discharge oil within the hydraulic chamber 57 can be maintained substantially constant as the minimum distance from the hydraulic chamber 57 to any one of the discharge ports 60*a* of the oil discharge grooves 60 wherever the hydraulic chamber 57 pressing the slide pin 45 is positioned by rotation of the valve lifter 18. Accordingly, the response in the transition of the valve from the operating state to the quiescent state can be substantially constant.

Moreover, the response can be controlled by the number of oil discharge grooves 87.

Next, a description is given of still another embodiment with reference to FIGS. 13 to 16.

A valve pausing mechanism 100 in a variable valve operating mechanism according to this embodiment includes oil discharge grooves 111 formed in a valve lifter 110 in the embodiment shown in FIGS. 1 to 9. The oil discharge grooves 111 correspond to the oil discharge groove 60 formed in the lifter guide hole 52 of the cylinder head 4. Other structures included are the same as those of the valve pausing mechanism 100 described in the above embodiment, that is, same members and same portions are shown using same reference numerals.

Figure 15:
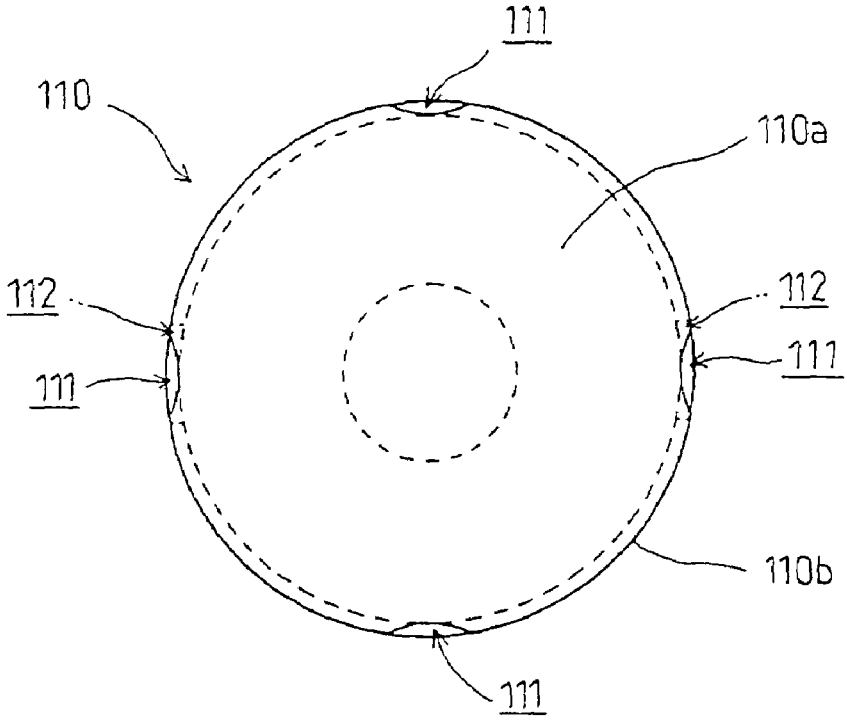
FIG. 15 is a top view of the valve lifter.
Figure 16:
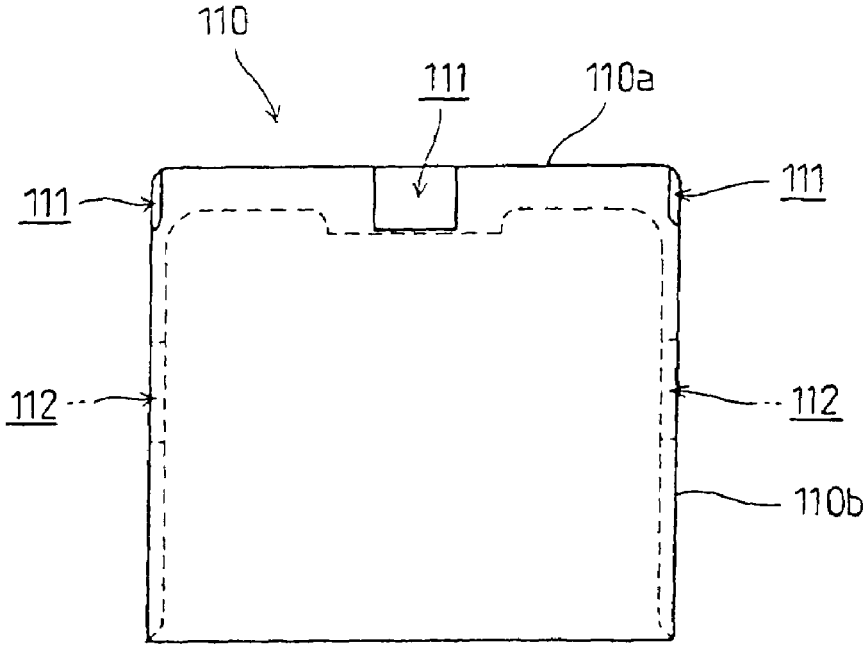
FIG. 16 is a side view of the valve lifter.

As shown in FIGS. 15 and 16, in the valve lifter 110, a pair of side holes 112 are drilled at predetermined places of a cylindrical peripheral wall 110*b* so as to be opposite to each other. Moreover, four of the oil discharge grooves 111 are formed at regular intervals in a peripheral edge portion of the outer peripheral surface of the peripheral wall 110*b* on a top wall 110*a* side.

Each of the oil discharge grooves 111 is formed by circularly cutting off the outer peripheral edge of the circular top wall 110*a* by a predetermined length in an axial direction.

The axial length of the oil discharge grooves 111 is equal to or less than wall thickness of the top wall 110*a*, so that it is prevented that the side wall of the valve lifter 110 is thinned and reduce the strength due to the oil discharge grooves 111.

A main portion of the valve pausing mechanism 100 (the same structure as that of the aforementioned embodiment) is fit in the valve lifter 110 and inserted in the lifter guide hole 52 of the cylinder head 4.

In the lifter guide hole 52, the annular hydraulic groove 53 is formed, but the oil discharge groove 60 is not formed.

Figure 13:
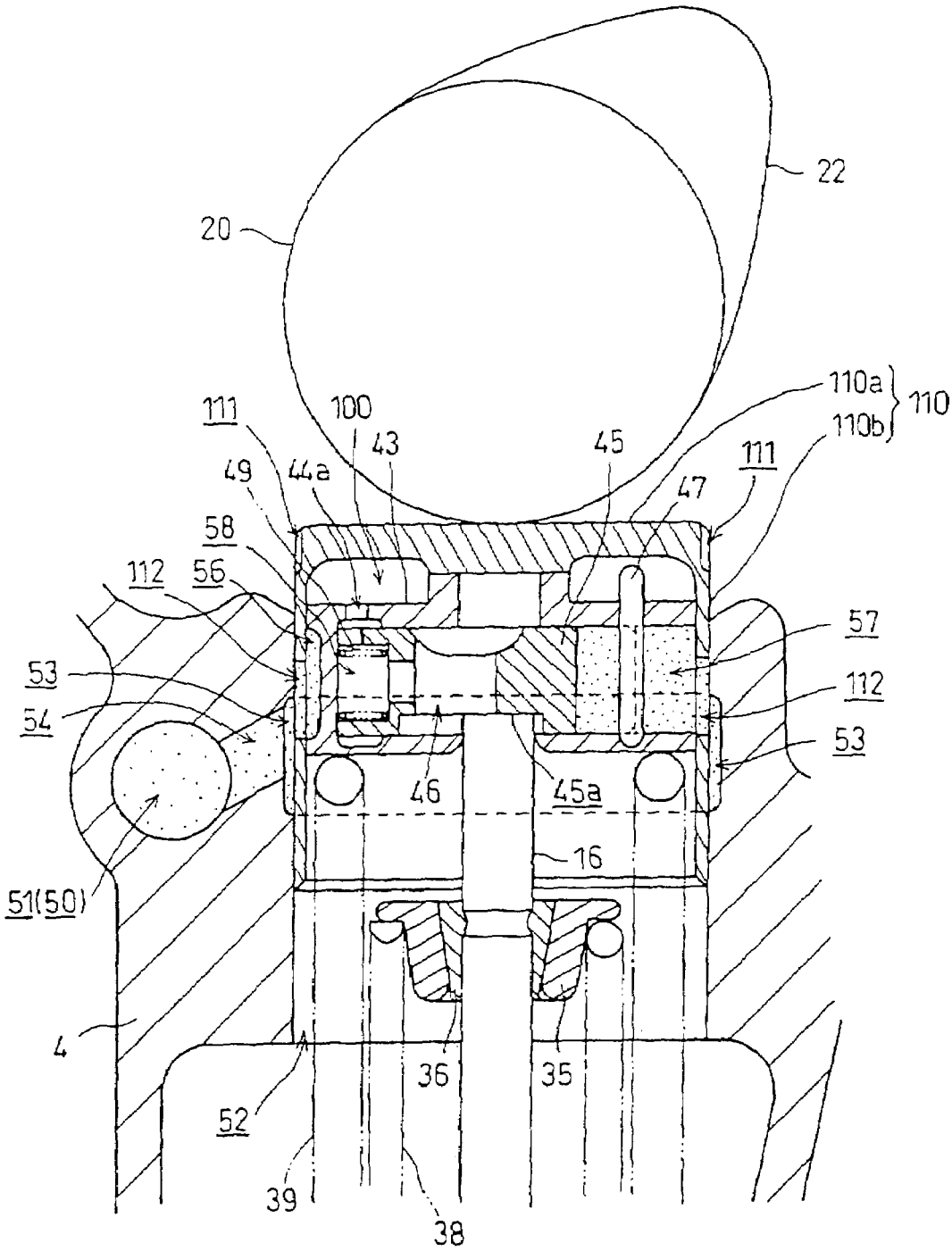
FIG. 13 is an enlarged cross-sectional view of the main potion when a valve lifter is located at an up position in a valve operating state in another embodiment.
Figure 14:
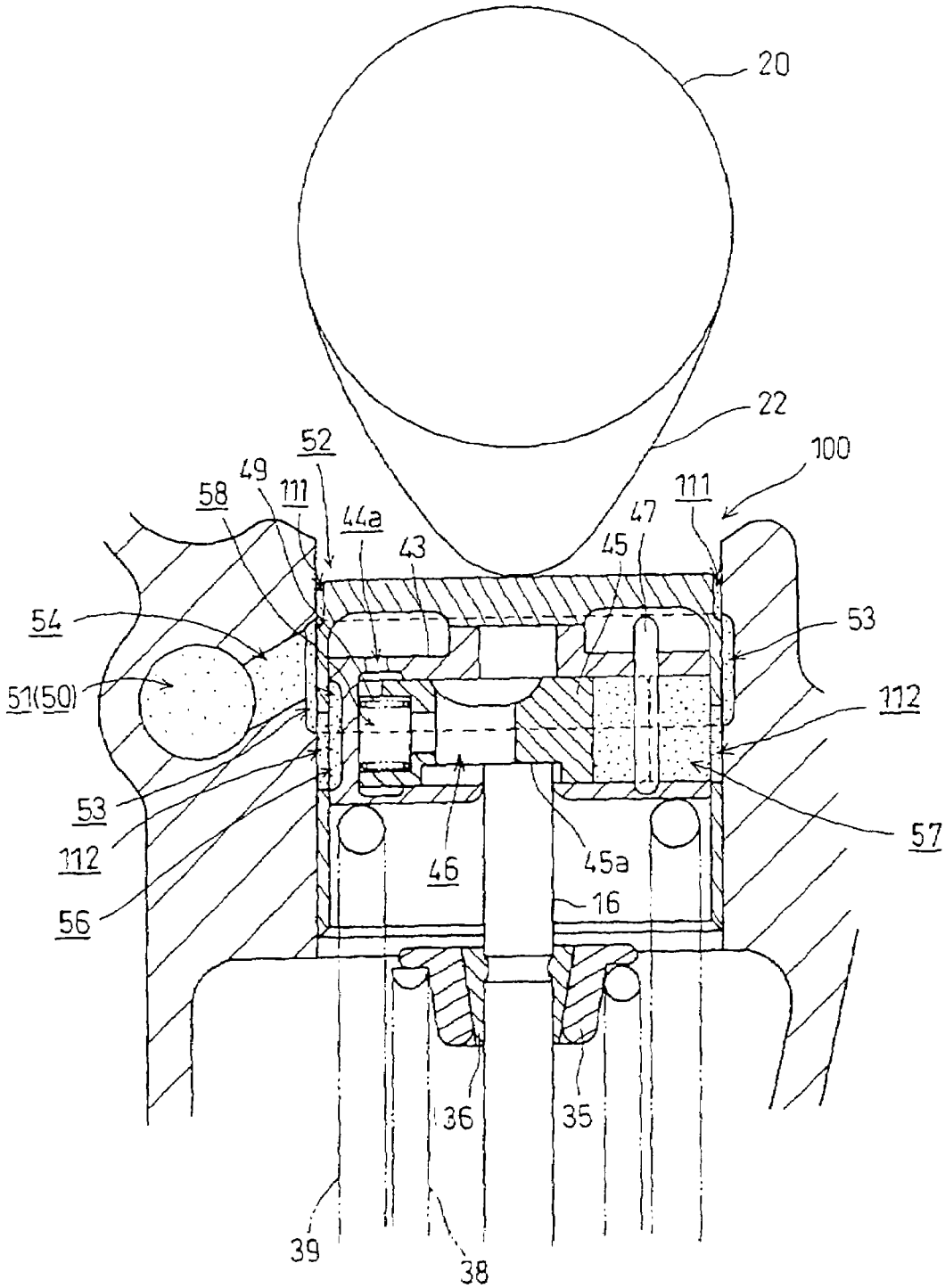
FIG. 14 is an enlarged cross-sectional view when the valve lifter is located at a down position in the valve operating state.

FIGS. 13 and 14 show status where the four-stroke internal combustion engine 1 is operated at high speed or high load. The slide pin 45 is moved against the spring force of the pin spring 49 by oil pressure of the hydraulic chamber 57. When the valve lifter 110 is driven up and down by the exhaust cam 22 (intake cam 21), the exhaust poppet valve 14 (intake poppet valve 13) is opened and closed through the slide pin 45.

FIG. 13 shows the valve lifter 110 abutting on a base circle of the exhaust cam 22 at a highest position. The pressurized oil is introduced from the hydraulic passage 51 through the communication hole 54, annular hydraulic groove 53, side holes 112, and outer peripheral recessed groove 56 to the hydraulic chamber 57 within the slide pin hole 44.

When rotation of the exhaust cam 22 causes a cam lobe to slide down the valve lifter 110 and the valve lifter 110 reaches substantially the lowest position as shown in FIG. 14, the oil discharge grooves 111 formed in the outer peripheral edge of the top wall 110*a* of the valve lifter 110 communicate with the annular hydraulic groove 53 of the lifter guide hole 52. Oil in the hydraulic chamber 57 is therefore discharged through the side holes 112 and annular hydraulic groove 53 from the oil discharge grooves 111.

If the oil pressure is released in the case where the valve comes into the valve quiescent state from the operating state, the oil pressure of the hydraulic chamber 57 is instantly relieved when the valve lifter 110 reaches substantially the lowest position. When the valve lifter 18 goes up to reduce the pressing force of the slide pin 45 of the valve stem 16 on the stem contact surface 45*a*, the slide pin 45 is moved by the spring force of the pin spring 49 to surely bring the valve into the quiescent state.

Accordingly, the slide pin 45 is moved to bring the valve into the quiescent state in a short response time after the release of oil pressure, and the response is considerably improved.

The higher the position of the upper end of the annular hydraulic groove 53, which is formed in the inner peripheral surface of the lifter guide hole 52, is, the earlier oil begins to be discharged, providing better response when the valve is brought into the quiescent state. However, this accordingly requires more oil to be discharged, and the position of the upper end of the annular hydraulic groove 53 is properly set based on the desired response and the oil feed performance of the internal combustion engine.

This embodiment is configured so that the oil discharge grooves 111 communicate with the annular hydraulic groove 53 to discharge oil in the hydraulic chamber 57 when the valve lifter 110 reaches substantially the lowest position. Accordingly, less pressure is lost when oil pressure is supplied, and the response when the valve is brought into the quiescent state from the operating state upon pressurization can be maintained.

In the outer peripheral edge of the top wall 110*a* of the valve lifter 110, the four oil discharge grooves 111 are formed. Accordingly, wherever the hydraulic chamber 57 pressing the slide pin 45 is positioned by rotation of the valve lifter 110, the path to discharge oil in the hydraulic chamber 57 can be maintained substantially constant as the minimum distance between the hydraulic chamber 57 and the oil discharge grooves 111. The response in the transition of the valve from the operating state to the quiescent state can be set substantially constant.

The number of the oil discharge grooves 111 may be increased. To the contrary, even if the number of oil charge grooves 111 is reduced, the response in the transition of the valve from the operating state to the quiescent state can be expected to some extent in its own way. The response time can be controlled by the number of the oil discharge grooves 111.

Figure 17:
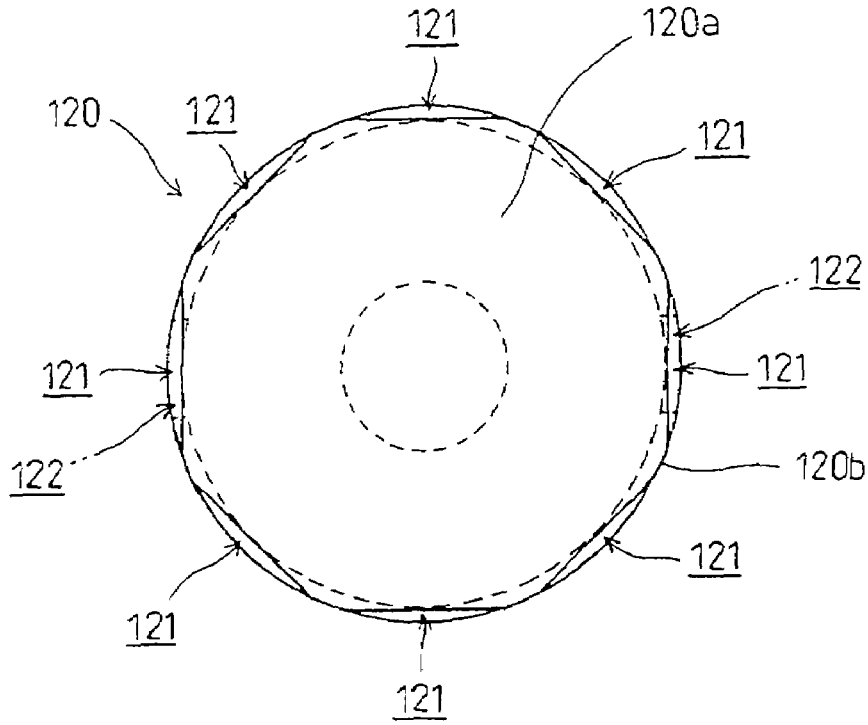
FIG. 17 is a top view of a valve lifter in another modification.
Figure 18:
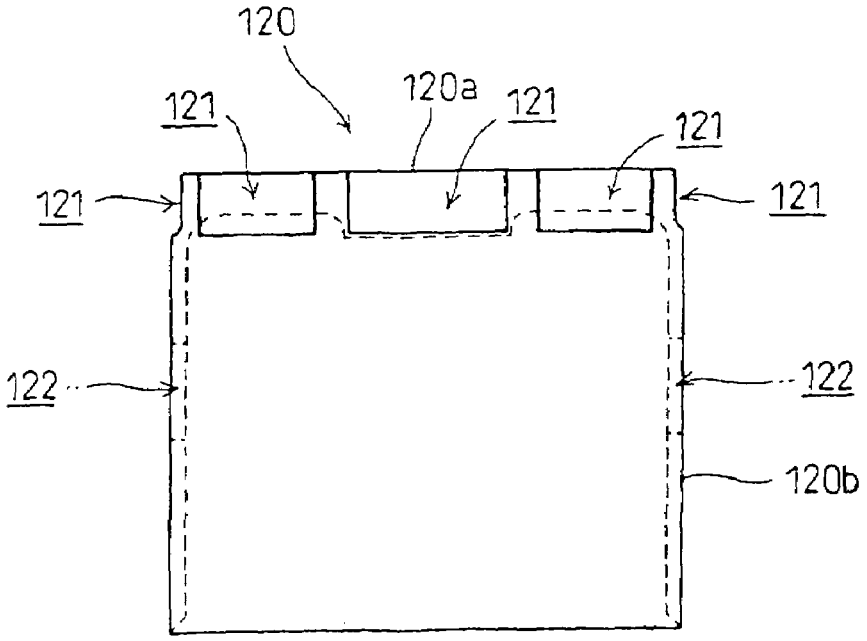
FIG. 18 is a side view of the valve lifter.

A modification of the oil discharge groove is shown in FIGS. 17 and 18.

In this valve lifter 120, a pair of side holes 122 are drilled at predetermined places in a cylindrical peripheral wall 120*b* so as to be opposite to each other, and eight oil discharge grooves 121 are formed at regular intervals in a peripheral edge portion of the outer peripheral surface of the peripheral wall 120*b* on the top wall 120*a* side.

Each of these oil discharge grooves 121 is formed by cutting off the outer peripheral edge of the circular top wall 120*a* by a predetermined length in the axial direction into a plane. The cutting surface forms a flat plane.

The axial length of the oil discharge grooves 121 is equal to or less than the wall thickness of the top wall, so that the oil discharge grooves 121 do not affect the strength of the peripheral wall 120*b*.

The eight oil discharge grooves 121 are substantially evenly formed in the outer peripheral edge of the top wall 120*a* of the valve lifter 120. Accordingly, even if the valve lifter 120 is rotated, the minimum distance between the hydraulic chamber and the places where the annular hydraulic groove communicates with the oil discharge grooves can be maintained substantially constant. The response time which is shortened by the oil discharge in the transition of the valve from the operating state to the quiescent state can be set substantially constant.

Figure 19:
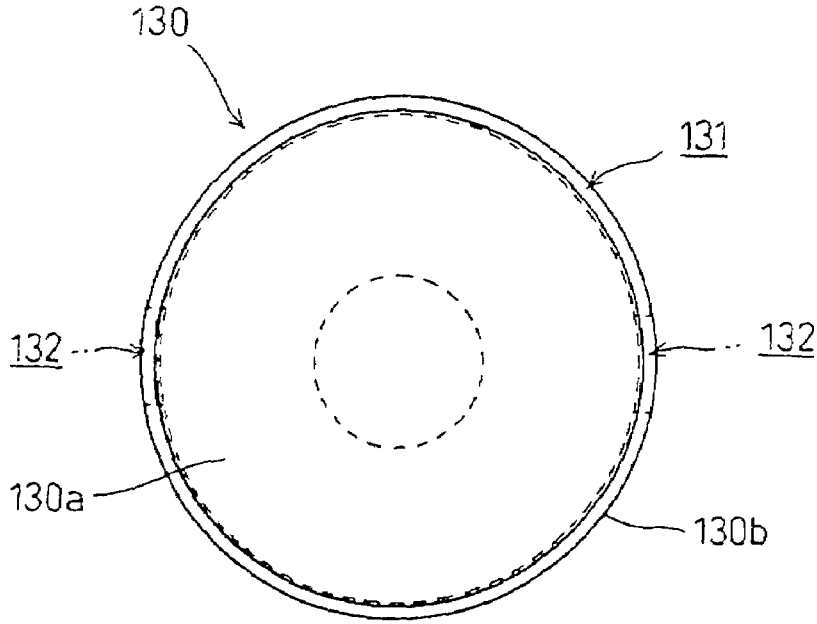
FIG. 19 is a top view of a valve lifter in still another modification.
Figure 20:
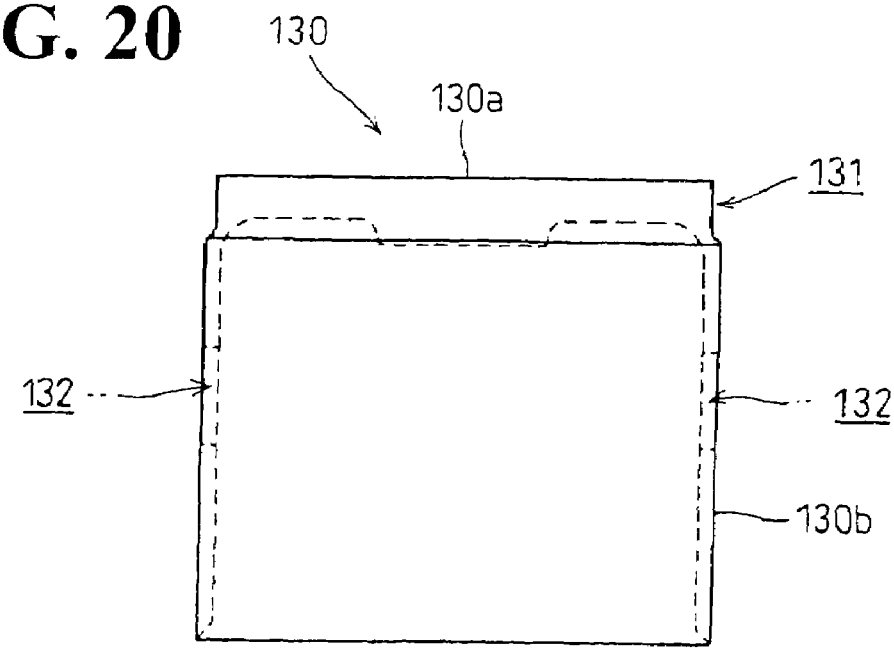
FIG. 20 is a side vide of the valve lifter.

Next, another modification of the oil discharge groove is shown in FIGS. 19 and 20.

In this valve lifter 130, a pair of side holes 132 are drilled at predetermined places of a cylindrical peripheral wall 130*b* so as to be opposite to each other, and an oil discharge groove 131 is formed annularly around the entire circumference of a peripheral edge portion of the outer peripheral surface of the peripheral wall 130*b* on the top wall 130*a* side.

The oil discharge groove 131 has an axial length equal to or less than the wall thickness of the top wall 130*a* and does not affect the strength of the peripheral wall 130*b*.

The oil discharge groove 131 is formed annularly around the entire circumference of the peripheral wall 130*b* of the valve lifter 130. Accordingly, rotation of the valve lifter 130 does not affect the response in the transition of the valve from the operating state to the quiescent state, and the response can be set always constant.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable valve operating mechanism of a four-stroke internal combustion engine, in which a valve lifter provided between a valve operating cam and a valve stem of a poppet valve is slidably supported by a lifter guide hole and always energized by a lifter spring in a direction to abut on the valve operating cam, a slide pin is fit to a slide pin holder attached in the valve lifter and freely slides in a direction orthogonal to the valve stem, a stem contact surface which abuts on the valve stem of the poppet valve energized by the valve spring and a stem through hole which the valve stem penetrates are formed in adjacent to each other in the slide pin, and the slide pin is energized by a pin spring in one direction while oil pressure acts on the slide pin in an opposite direction through an oil pressure supply passage, and the slide pin is moved by controlling the oil pressure to cause the stem contact surface and stem through hole to selectively face the valve stem, the variable valve operating mechanism comprising:

an oil discharge passage including a discharge port which is opened to allow oil acting on the slide pin to be discharged when the valve lifter is pressed by the valve operating cam to move for opening the valves, wherein the oil pressure supply passage is composed of an annular hydraulic groove communicating through a side hole of the valve lifter with a hydraulic chamber causing oil pressure to act on the slide pin, the annular hydraulic groove being formed in an inner peripheral surface of the lifter guide hole and supplied with oil pressure, the oil discharge passage is composed of an oil discharge groove extending from the annular hydraulic groove in a direction that the valve lifter moves for closing the valve, and a discharge port of the oil discharge groove is opened when the valve lifter is pressed by the valve operating cam to move for opening the valve.

2. The variable valve operating mechanism of the four-stroke internal combustion engine according to claim 1, wherein a plurality of the oil discharge grooves are formed in the inner peripheral surface of the lifter guide hole across a circumferential direction.

3. The variable valve operating mechanism of the four-stroke internal combustion engine according to claim 1, wherein a plurality of the oil discharge grooves are formed in the inner peripheral surface of the lifter guide hole across a circumferential direction.

4. The variable valve operating mechanism of the four-stroke internal combustion engine according to claim 1, wherein the oil discharge passage is formed in the valve lifter.

5. The variable valve operating mechanism of the four-stroke internal combustion engine according to claim 1, wherein at least a portions of the oil pressure supply passage and the oil discharge passage are formed in an inner peripheral surface of the lifter guide hole.

6. A variable valve operating mechanism of a four-stroke internal combustion engine, in which a valve lifter provided between a valve operating cam and a valve stem of a poppet valve is slidably supported by a lifter guide hole and always energized by a lifter spring in a direction to abut on the valve operating cam, a slide pin is fit to a slide pin holder attached in the valve lifter and freely slides in a direction orthogonal to the valve stem, a stem contact surface which abuts on the valve stem of the poppet valve energized by the valve spring and a stem through hole which the valve stem penetrates are formed in adjacent to each other in the slide pin, and the slide pin is energized by a pin spring in one direction while oil pressure acts on the slide pin in an opposite direction through an oil pressure supply passage, and the slide pin is moved by controlling the oil pressure to cause the stem contact surface and stem through hole to selectively face the valve stem, the variable valve operating mechanism comprising:

an oil discharge passage including a discharge port which is opened to allow oil acting on the slide pin to be discharged when the valve lifter is pressed by the valve operating cam to move for opening the valve, wherein the slide pin holder includes an outer peripheral recessed groove for communicating with the oil pressure supply passages, wherein the oil pressure supply passage is composed of an annular hydraulic groove communicating through a side hole of the valve lifter with a hydraulic chamber causing oil pressure to act on the slide pin in said slide pin holder, the annular hydraulic groove being formed in an inner peripheral surface of the lifter guide hole, the oil discharge passage is composed of an annular oil discharge groove which is formed in the inner peripheral surface of the lifter guide hole apart from the annular hydraulic groove in a direction that the valve lifter moves for valve opening and is communicable with the hydraulic chamber through the side hole of the valve lifter and an oil discharge groove extended from the annular oil discharge groove in a direction that the valve lifter moves for opening the valve, and the oil discharge groove is always opened.

7. The variable valve operating mechanism of the four-stroke internal combustion engine according to claim 6, wherein a plurality of the oil discharge grooves are formed in the inner peripheral surface of the lifter guide hole across a circumferential direction.

8. The variable valve operating mechanism of the four-stroke internal combustion engine according to claim 6, wherein a plurality of the oil discharge grooves are formed in the inner peripheral surface of the lifter guide hole across a circumferential direction.

9. The variable valve operating mechanism of the four-stroke internal combustion engine according to claim 6, wherein the oil discharge passage is formed in the valve lifter.

10. The variable valve operating mechanism of the four-stroke internal combustion engine according to claim 6, wherein at least a portions of the oil pressure supply passage and the oil discharge passage are formed in an inner peripheral surface of the lifter guide hole.

11. A variable valve operating mechanism of a four-stroke internal combustion engine, in which a valve lifter provided between a valve operating cam and a valve stem of a poppet valve is slidably supported by a lifter guide hole and always energized by a lifter spring in a direction to abut on the valve operating cam, a slide pin is fit to a slide pin holder attached in the valve lifter and freely slides in a direction orthogonal to the valve stem, a stem contact surface which abuts on the valve stem of the poppet valve energized by the valve spring and a stem through hole which the valve stem penetrates are formed in adjacent to each other in the slide pin, and the slide pin is energized by a pin spring in one direction while oil pressure acts on the slide pin in an opposite direction through an oil pressure supply passage, and the slide pin is moved by controlling the oil pressure to cause the stem contact surface and stem through hole to selectively face the valve stem, the variable valve operating mechanism comprising:

an oil discharge passage including a discharge port which is opened to allow oil acting on the slide pin to be discharged when the valve lifter is pressed by the valve operating cam to move for opening the valve wherein the oil pressure supply passage is constituted of an annular hydraulic groove communicating through a side hole of the valve lifter with a hydraulic chamber causing oil pressure to act on the slide pin, the annular hydraulic groove being formed in an inner peripheral surface of the lifter guide hole and supplied with oil pressure, wherein the oil discharge passage is constituted of an oil discharge groove formed in a peripheral edge portion of a peripheral wall of the valve lifter on a top wall side, and wherein the oil discharge groove communicates with that annular hydraulic groove at a predetermined position when the valve lifter is pressed by the valve operating cam to move for opening the valve.

12. The variable valve operating mechanism of the four-stroke internal combustion engine according to claim 11, wherein the oil discharge passage is formed in the valve lifter.

13. The variable valve operating mechanism of the four-stroke internal combustion engine according to claim 11, wherein a plurality of the oil discharge grooves are formed around the entire circumference of the peripheral wall of the valve lifter.

14. The variable valve operating mechanism of the four-stroke internal combustion engine according to claim 11, wherein the oil discharge groove is an annular groove formed annularly around the entire circumference of the peripheral wall of the valve lifter.

15. The variable valve operating mechanism of the four-stroke internal combustion engine according to claim 11, wherein at least a portions of the oil pressure supply passage and the oil discharge passage are formed in an inner peripheral surface of the lifter guide hole.

* * * * *